United States Patent [19]

Zitelli et al.

[11] 4,099,237

[45] Jul. 4, 1978

[54] PROGRAMMABLE TURBINE SPEED CONTROLLER

[75] Inventors: William E. Zitelli, Monroeville; James M. Mussler, Bethel Park; Andras I. Szabo, Murrysville Borough, all of Pa.

[73] Assignee: Westinghouse Electric Corp., Pittsburgh, Pa.

[21] Appl. No.: 771,141

[22] Filed: Feb. 23, 1977

[51] Int. Cl.[2] ..... F01B 25/06; F01K 13/02; G05B 19/02

[52] U.S. Cl. ..... 364/494

[58] Field of Search ..... 235/151.21, 151; 444/1; 60/660; 290/40 R, 40 A; 415/15-17

[56] References Cited

U.S. PATENT DOCUMENTS

| | | | |
|---|---|---|---|
| 3,859,007 | 1/1975 | Kowalski, et al. | 60/660 X |
| 3,965,684 | 6/1976 | Nomura | 60/660 |
| 4,016,723 | 4/1977 | Farley | 235/151.21 X |
| 4,028,532 | 6/1977 | Reuther | 235/151.21 X |

*Primary Examiner*—Edward J. Wise
*Attorney, Agent, or Firm*—H. W. Patterson

[57] ABSTRACT

A microprocessor-based turbine speed controller which incorporates a set of permanently programmable memory devices for characterizing the control of turbine speed in real time is disclosed. A speed monitoring interface circuit included in the speed controller is governed by the microprocessor in accordance with the processing of one program stored in one or more of the permanently programmable memory devices to generate speed measurement data words representative of actual turbine speed. In addition, a power-on initialization circuit initializes the microprocessor at the time of power turn-on to process another program stored in one or more of the permanently programmable memory devices for initializing a plurality of predetermined registers contained in the speed controller corresponding to the characterized speed control operation to be performed by each. Further apparatus and programmed instructions for the control thereof are employed to detect a malfunction in program execution by the microprocessor. Additional apparatus is included to provide a speed control signal output and to condition a plurality of digital input and output signals. All microprocessor processing operations are synchronously time sequenced using the signals generated by a system clock.

27 Claims, 24 Drawing Figures

PROGRAMMABLE TURBINE SPEED CONTROLLER

BACKGROUND OF THE INVENTION

This invention relates to turbine speed controllers and more particularly to a microprocessor-based turbine speed controller characterized by a set of permanently programmable memory devices contained therein.

The basic speed control of a turbine is usually accomplished by: monitoring the speed of a turbine employing a notched wheel attached to the turbine shaft and a magnetic pickup coupled adjacent thereto which generates a periodic time varying signal representative of turbine speed; subtracting said speed representative signal from a desired turbine speed signal to generate a speed error signal; and operating on said speed error signal with a dynamic controller to generate a signal which is used to position one or more fluid admission control valves to converge the speed of the turbine to that desired. In the late 50's and early to mid 60's, turbine speed controllers were comprised, for the most part, of a combination of analog and digital electronic hardware with a functional operation defined by a fixed hardwired structure. Problems with errors in speed control as a result of environmental changes, aging, and power supply variations were uncovered in the analog electronic hardware of these earlier hybrid systems. Consequently, some turbine speed controller manufacturers replaced the susceptible analog electronic hardware with digital electronic hardware. These all digital electronic type controllers, similar to that described in U.S. Pat. No. 3,802,188; by Barrett, issued Apr. 9, 1974, while overcoming the effects of environmental, aging and power supply variations, still maintained a fixed wired structure defining a particular operation.

As time passed, technological improvements in analyzing turbine systems lead to varying protective features in controlling the speed of the turbine. For example, measuring the temperatures of steam and metal at specific cross-sectional locations of the turbine during speed control operation was considered a viable method of establishing uneven heating of the turbine parts; the introduction of a mathematical rotor model established the possibility of calculating on-line the present and predicated stresses on the turbine rotor in accordance with certain measured parameters; and the capability of predicting the speed zones of vibration in accordance with steam conditions and blade design established the possibility of eliminating the danger of dwelling in these vibrating speed zones during speed control operation. These examples are just a few. Because some of these protective features are of paramount importance to the availability of the turbine operation, they have been required in some turbine installations. Speed control operational characteristics were varied, in many instances, from one turbine building block to another and from one turbine installation to another. The fixed wired speed controllers became costly to modify and expand to satisfy the protective requirements of a turbine installation.

About at this time, general purpose minicomputers were being introduced in the process control arena. Minicomputer-based turbine controllers, similar to that described in the copending application, Ser. No. 722,799; titled "Improved System And Method For Operating A Steam Turbine And Electric Power Generating Plant"; filed by Giras and Birnbaum on Apr. 4, 1968 and continued as Ser. No. 124,993 on Mar. 16, 1971 and Ser. No. 319,115 on Dec. 29, 1972, alleviated the problems of a fixed wired hardware structure by permitting turbine control operation to be characterized by a set of programs. Quite a few large turbine systems could justify the expense of a general purpose, minicomputer-based turbine controller because of the added features of automatic start-up, synchronization and automatic efficient load control afforded thereby. However, some municipalities and industrial complexes employ smaller turbines, on the order of 300 megawatts or less, which incorporate simple fluid admission control valving arrangements usually actuated by mechanical-hydraulic means as opposed to the large turbines, say 1,000 megawatts or greater, which use a variety of complex electrohydraulic actuated valving arrangements. These smaller turbines have generally been controlled by an operator using a basic fixed hardwired speed controller similar to the one previously described above. In these cases, the operator performs the protective control of the turbine, manually, according to a set of operational limitations provided to him by the turbine manufacturer.

Presently, there appears to exist a large gap in turbine speed control systems between the fixed hardwired speed controllers and the programmable minicomputer-based speed controllers. There are times when it is desirable to automatically protect the smaller turbine systems during start-up operations to ensure the availability and increase the economic efficiency thereof. To satisfy those small turbine system users who cannot justify the cost of a large programmable minicomputer-based speed controller, but find it desirable and request the ability to add, alter or modify certain protective features for their start-up operations, it may be advantageous to consider a turbine speed controller which consolidates the basic speed control functions in hardware, but allows programmable characterization of operation therein and is cost competitive with the fixed hardwired systems described above.

Additionally, the present programmable controllers of the type described in the application, Ser. No. 319,115 referenced to hereinabove, require special memory programming and loading techniques corresponding to the minicomputer associated therewith. Some even require power supply sequencing upon power turn-on and are susceptible to random electrical noise "spikes". These noise "spikes" may lead to a change in an instruction in the read/write memory contained in the minicomputer system which could cause an eventual shutdown of the turbine. It appears that a turbine control system which could fill the existing gap in turbine speed controllers and also provide for characterizing speed control operation as required while emulating a hardwired controller would reduce the probability of electrical noise shutdown thus increasing the availability of the turbine.

SUMMARY OF THE INVENTION

A microprocessor-based speed controller apparatus for controlling the speed of a turbine as characterized by a set of permanently programmable memory devices contained therein is disclosed. The speed controller apparatus comprises a microprocessor, a system and real time clock generator, an automatic power-on initialization circuit, a plurality of digital input/output (I/O) interface conditioning circuits, a speed monitoring interface circuit, a speed control signal generation circuit, an analog input (A/I) interface circuit, a memory for temporary storage of data words a plurality of memory devices for permanent storage of addressably ordered sets of instructions and data words characterizing the operaion of the speed controller and a program execution failure detection circuit. Each of the circuits described above are coupled to a microprocessor bus. The speed controller apparatus is arranged such that instructions and data words may be conducted over the microprocessor bus to each of the circuits coupled thereto in a synchronous time sequenced manner governed by the processing operations of the microprocessor.

Apparatus is provided to control the processing of the addressably ordered sets of selected instructions and data words of the plurality of memory devices. The selected instructions and data words and the addressable order in which they may be permanently programmed in the memory devices may be utilized to characterize the operation of the speed controller in controlling the speed of the turbine.

The speed monitoring interface circuit and permanently programmed processing instructions for the control thereof are provided to generate one or more speed measurement data words during each period of a timing signal generated by the real time clock generator. The speed measurement data words are formed by the accumulation of speed pluses representative of turbine speed by a counter contained in the speed monitoring interface circuit. The operation of the speed monitoring circuit is controlled by the processing of a first set of instructions by the microprocessor during a specified time interval during each period of the real time clock generated signal. Between said specified time intervals, the speed monitoring interface circuit may be controlled by the processing of a second set of instructions by the microprocessor as dictated by a counter overflow event. In each case, the contents of the counter may be read and stored in memory by the microprocessor and the counter may be initialized to generate another speed measurement data word. Additional apparatus isprovided to store a speed pluse which may occur during an instruction processing time interval and to inject said stored speed pulse into the initialized counter immediately thereafter so as not to lose count of any of the speed pulses which represent the turbine speed.

A power-on initialization circuit nd permanently programmed processing instructions associated therewith are provided to permit the initialization of storage and control registers contained in the interface and memory circuits. At the time of power turn-on, the microprocessor is signaled to supply predetermined data words to selected storage and control registers corresponding to the desired operation to be performed by the interface or memory circuit associated therewith. In this manner, the speed controller emulates the power-on operation of a hardwired system.

Apparatus is additionally provided to supply trigger pulses to one or the other of two retriggerable monostable multivibrators upon the execution of a plurality of specified instructions by the microprocessor. The outputs of the two monostables are "and"ed such that if either one or both outputs are logically false, a program execution failure signal is produced. In addition, circuitry is incorporated to detect a power supply failure and inhibit the functioning of the monostables as a result thereof.

In the speed control signal generation circuit, apparatus is provided to accept speed control signal data words from the microprocessor and convert them to both a voltage and current analog form thereby permitting a choice of either a voltage or a current signal supplied therefrom. Signal conditioning and buffering circuits for digital input/ouput signals are provided and may be configured for use in a variety of applications. In addition, a set of switches are interfaced to the microprocessor for the purpose of providing a digital code thereto.

DESCRIPTION OF THE PREFERRED EMBODIMENT

Figure 1:
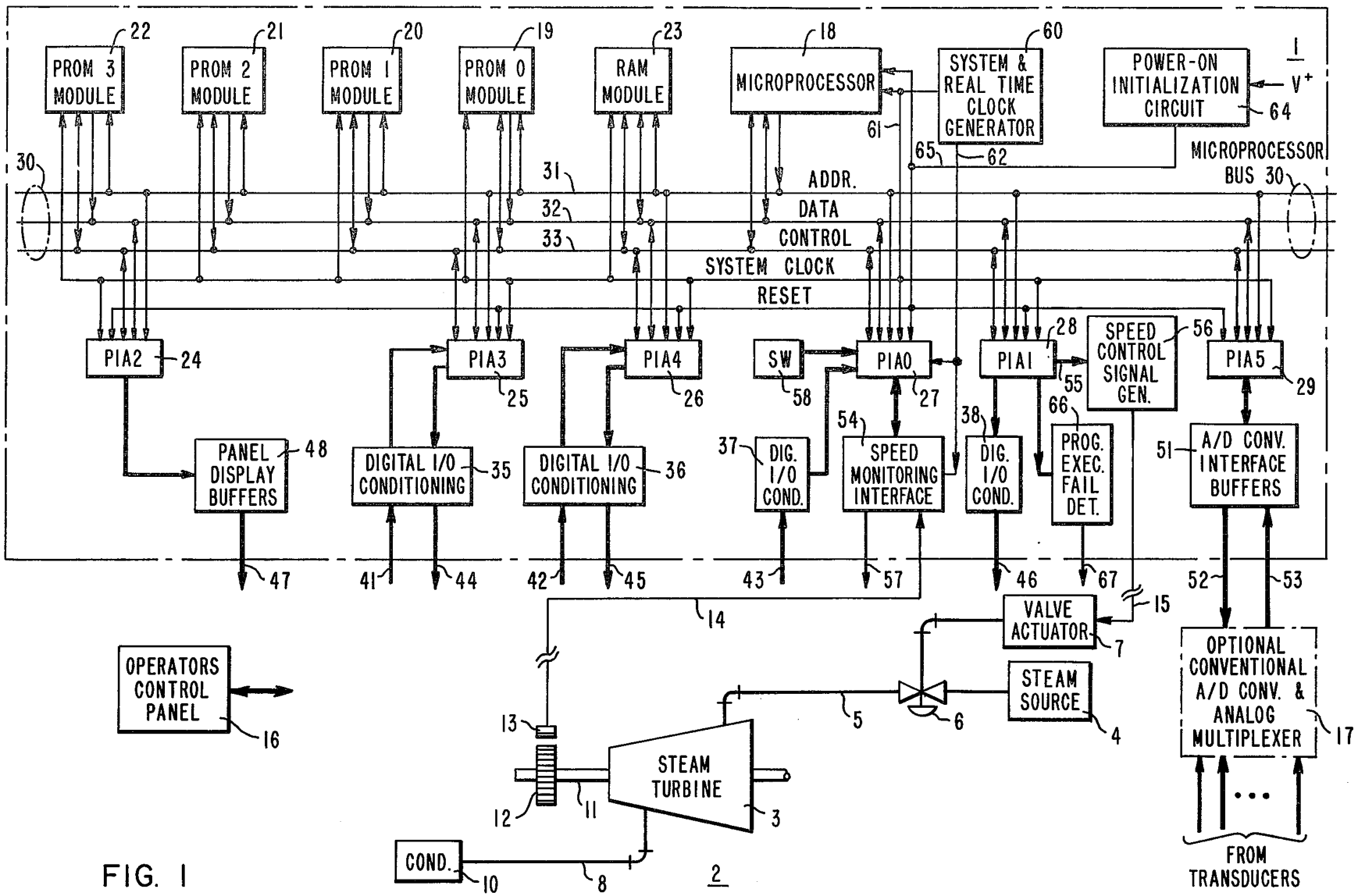
FIG. 1 is a schematic block diagram of a programmable turbine speed controller apparatus and a steam turbine system embodying the present invention.

Referring to FIG. 1, a microprocessor-based turbine speed controller 1 may be used to control the speed of a steam turbine system 2 in accordance with an operational characterization programmed therein. Steam is supplied to a steam turbine 3 from a conventional steam source 4 through steam piping 5. One or more typical steam admission valves 6 are actuated by a conventional valve actuating means 7 to govern the steam flow to the steam turbine 3. Steam exhausts from the steam turbine 3 through exhaust piping 8 to a condenser 10. As steam expands through the steam turbine 3, energy is transferred to the turbine blading, not shown in FIG. 1, to exert a torque on a turbine shaft 11. The net torque of the steam turbine 3 imparted to the shaft 11 accelerates the shaft to a desired speed. Speed may be detected by utilizing a notched wheel 12 attached to turbine shaft 11 and a standard variable reluctance type detector 13 coupled adjacent thereto, for example. Detector 13 normally generates a periodic time varying signal of a waveform similar in nature to a sine wave over signal line 14. The frequency of the generated time varying waveform is generally proportional to the speed of the turbine shaft 11. The speed signal generated over line 14 is monitored by speed controller 1 and a speed control signal 15 is generated thereby in accordance with the programmed operational characteristics thereof. Other equipment which may be used to coordinate the speed control activities of the speed controller 1 in both an automatic or supervisory mode are an operator's control panel 16 and a conventional analog input (A/I) system 17 to monitor selected turbine system variables from their associated transducers.

More specifically, a microprocessor 18 processes instructions contained in a plurality of memory devices 19, 20, 21, 22 to read in data, to perform logical or arithmetic operations on data contained therein, and to write out processed data. A selected portion of the processed data may be stored in a temporary storage device 23. The microprocessor 18 additionally controls the flow of input/output (I/O) data using a plurality of programmed iterface units 24, 25, 26, 27, 28 and 29. All of the aforementioned devices 18 through 29 may be connected in parallel to a common microprocessor bus 30 which includes signal conduction portions for an address word 31, bidirectional data words 32 and control signals 33. Digital input and output signals are conditioned prior to being monitored and controlled by signal conditioning functions 35, 36, 37 and 38 which are coupled to interface units 25, 26, 27 and 28, respectively. Digital inputs 41, 42 and 43 may be provided from push buttons on control panel 16 or from contacts in the turbine system 2 identifying the status thereof. Digital output signals 44, 45 and 46 may be supplied to drive status lamps on the control panel or to drive interposing relays used to annunciate status or to control selected portions of the operation of the turbine system 2. Additional digital output signals 47 are provided to possibly drive digital binary coded decimal (BCD) displays, which may be located on the operator's panel 16, through panel display buffer 48 which is coupled to interface unit 24.

In the case in which a conventional analog input (A/I) system 17 is used, an interface buffering unit 51 coupled to programmed interface unit 29 provides both the address and control signals 52 needed for the multiplexing and digitizing operations of the A/I system 17 and the buffering needed to access the digitized data 53 therefrom. The periodic time varying speed signal of signal line 14 is an input to the speed monitoring interface 54 which, in turn, is coupled to the interface unit 27. An analog signal representative of turbine speed is also generated by the speed monitoring interface 54 over signal line 57. Accordingly, a digital speed control signal 55 is generated from the interface unit 28 and converted to the analog speed control signal 15 by a speed control signal generator 56. The speed control signal 15 controls the valve actuator means 7 to govern the positions of the one or more inlet steam admission valves 6 which vary the steam conducted to the steam turbine 3 thereby controlling the speed of the turbine 3. An arrangement of switches 58 are also coupled to the interface unit 27. The switches 58 may be positioned in a plurality of states.

Such that the transfer of the address word 31, the data word 32 and control signals 33 are conducted over the microprocessor bus 30 synchronous to the sequential processing operations of the microprocessor 18, a system clock generator 60 is provided. A system clock signal 61 generated thereby is distributed to all of the devices coupled to the microprocessor bus 30. A real time clock signal 62 is also generated by the generator 61 and supplied to the speed monitoring interface 54 and the interface unit 27. Initialization of the turbine speed controller 1 is initiated by the power-on initialization circuit 64 by supplying an initialization signal 65 to the microprocessor 18 and interface units 24, 25, 26, 27, 28 and 29. To identify a malfunction in program execution of the microprocessor 18, a falure detect circuit 66 is coupled to interface unit 28 to provide a failure detect signal 67 therefor.

For the purposes of this embodiment, taking into consideration the economic and reliability advantages, the turbine speed controller may be implemented on one printed circuit board and all of the interconnections may consist of printed circuit runs. A family of large scale integrated (LSI) circuit devices similar to that manufactured by Motorola Semiconductor Products, Inc., namely the M6800 Microcomputer Family, are used for this embodiment. The microprocessor 18 may be of the type MC6800 Microprocessing Unit (MPU); the temporary storage memory device 23 may be of the type MCM6810 Static Random Access Memory (128 ×

8); the interface units 24 through 29 may be of the type MC6820 Peripheral Interface Adapter (PIA) — all manufactured by Motorola. The memory devices 19, 20, 21 and 22 may be of the type manufactured by Intel Corp. Model No. 3604 programmable read only memory (PROM) wherein each device may store 512 8-bit words. The selected addressable order in which predetermined instructions and data words may be permanently programmed in the memory devices may characterize the sequential operation of the speed controller 1.

Figure 2:
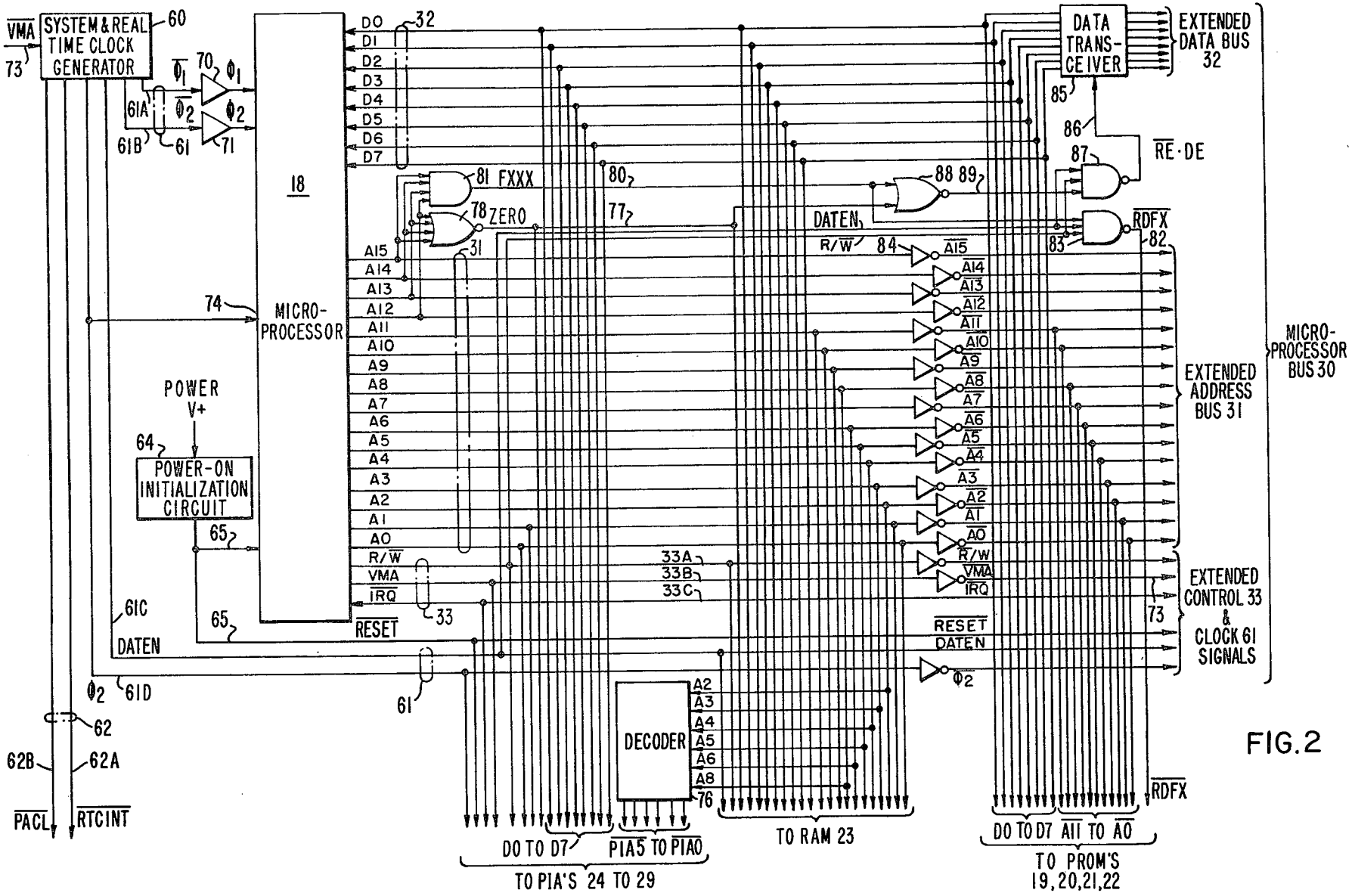
FIG. 2 is a more detailed schematic of a microprocessor-based system bus structure suitable for use in the embodiment of FIG. 1.

Typically, the operation of the speed controller 1 starts from the power V+ being turned on. The power-on initialization circuit 64 detects the power turn-on condition and responds by sending an initialization pulse of a pre-selected time duration over line 65 to the microprocessor 18 and interface units 24 through 29. A plurality of programming registers contained in the interface units, not shown in FIG. 2, are cleared to all logical zeros during the initialization pulse. These programming registers will be described in greater detail below. The microprocessor 18 responds to the reset pulse by vectoring to its starting instruction address as programmed in one of the memory devices 19 through 22. After the initialization pulse, the microprocessor 18 proceeds to process the programmed instructions of the memory devices 19 through 22 at a frequency controlled by the system clock signal 61. At times, designated by the addressable order of the instructions of the memory, the microprocessor 18 may address one or more of the registers contained in the interface units 24 through 29 to read data from or write data into said registers as controlled by the system clock signal 61, state of the control signals 33 and address of the corresponding register. This will be explained in more detail herebelow.

Normally the speed signal 14 as conditioned by the speed monitoring interface 54 is read in by the microprocessor 18 at a minimum frequency which will allow stable control of the steam turbine 2. The speed signal monitoring frequency is usually determined by the real time clock signal 62. Likewise, the speed control signal generator 56 may be updated at a similar frequency to ensure stable control of the steam turbine 2 by the speed control signal 15. The operation of the turbine controller 1 as characterized by one set of programmed memory devices 19 through 22 may be to read in a speed signal dta word through interface unit 27, to operate on this speed signal and to generate a new speed control signal 55 which is written out to interface unit 56. Digital outputs included in signals 44, 45, 46 and 47 which may be coupled to status lamps, displays and relays may also be updated at frequency synchronous to the clock signal 62. Normally, the digital inputs included in signals 41, 42 and 43 change state synchronous to the clock signal 62, however as will be described in more detail below, these digital input states may be monitored at times synchronous to the real time clock frequency signal 62. The data which is constantly being updated by the processing operation of the microprocessor 18 may be temporarily stored in predetermined addressed registers of the temporary storage memory 23.

Another set of programmed memory devices 19 through 22 may characterize the speed controller to monitor and control speed of the turbine 2 in accordance with the values of selected turbine variables such as temperature or pressure measured with conventional transducers which may be coupled to channels of an analog input system 17. In this case, during the processing operations of the microprocessor 18, it is necessary to address and control the analog-to-digital conversion of each channel and to establish conversion completion and transfer digitized data 53 from the A/I system 17 to the microprocessor 18 utilizing devices 29 and 51. Digitized data representing the turbine variables may be compared with predetermined limits or may be used in an algorithm representing a model of a portion of the turbine. In either case, responsive speed control action may be effected in accordance with the frequency of program execution. It is apparent that there can exist a large number of practical methods of controlling turbine speed as a function of measured turbine speed and other selected digital or analog variables and that the speed controller 1 attempts to characterize a reasonable number of the methods by providing a turbine controller architecture suitable for all such applications.

In FIG. 2, the microprocessor bus 30 including the address word 31, the bidirectional data word 32 and control signals 33, is shown in greater detail connected to the microprocessor 18. Also included in greater detail are the signals 61 and 62 generated from the system and real time clock generator 60 and signal 65 generated by the power-on initialization circuit 64.

The power-on initialization circuit 64 detects the turn-on of power V+ and generates the initialization pulse over signal line 65. Concurrently, the system and real time clock generator 60 begins generating a 2-phase periodic system clock signal including a $\theta_1$ signal 61A and $\theta_2$ signal 61B to control the synchronous processing operations of the microprocessor 18. Conventional clock drivers 70 and 71 are used to interface $\theta_1$ signal 61A and $\theta_2$ signal 61B, respectively, to the microprocessor 18. One of the control signals 33, namely valid memory address (VMA) 33B, is generated by the microprocessor 18 to ensure a proper exchange of information over the microprocessor bus 30. An inverted VMA, 33B, denoted as VMA (i.e. the complement of VMA) 73 is used to govern the generation of the system clocks 61 by the circuit 60. Two other system signals $-\theta_2$ 61D which is the complement of $\theta_2$ 61B and DATEN 61C which is the result of $\theta_2$ 61D "and"ed with VMA 33B; are generated by circuit 60 and distributed to all of the devices attached to the microprocessor bus 30 to synchronize the flow of information conducted between the microprocessor 18 and said devices.

During some periods (machine cycles) of the 2-phase system clock 61, when the signal $\theta_2$ generated by clock driver 71 is logically true, the microprocessor 18 generates an address conducted over the address bus 31, designated by a specific state of logical true and false signals on signal lines A0, A1, . . . A15, to either read in a data word or write out a data word over the data bus 32. At times when the microprocessor 18 addresses a device to read in a data word therefrom, a read/write (R/W) signal 33A and the VMA signal 33B of the control signals 33 are both logically true. Then during a read machine cycle, a device attached to the microprocessor bus 30 is addressed and controlled to present a data word over data bus 32 as governed by control signals 33A and 33B and timing signals 61C and 61D. Likewise, at times when the microprocessor 18 addresses a device to write out a data word thereto, the R/W signal 33A is logically false and the VMA signal 33B is logically true. Then during a write machine cycle, a device attached to the microprocessor bus 30 is addressed and controlled to accept a data work over data bus 32 as governed by control signals 33A, 33B, 61C and 61D. The data word conducted over data bus 32 consists of a plurality of parallel signal lines DO, . . . D7 wherein DO represents the least significant bit (LSB) and D7 represents the most significant bit (MSB). To ensure that data is read in or written from the microprocessor 18 only during the portions of each machine cycle of signal 61 when $\theta_2$ is logically true, the signal 61D is connected to the data bus enable input 74 of the microprocessor 18. The data bus is only enabled during the logical true state of $\theta_2$.

Each device attached to the microprocessor bus 30 has an address distinguishable from any other device attached thereto such that there may exist no conflict in supplying data to or accepting data from the data bus 32. The temporary storage memory 23 which is normally accessed randomly by the microprocessor 18 has register addresses distinguishable by the least significant 7 bits A0, A1, . . . A6 of the address lines 31. The microprocessor 18 may address the registers of device 23 using its most efficient, direct address, mode of addressing for random access. A true signal ZERO 77 is generated by NOR gate 78 only when all of the most significant address signals A12, A13, A14 and A15 are logically false. The signal 77 along with address lines A8, A9, A10 and A11 are provided to device 23 to ensure a unique address for each register contained therein. In addition, signal R/W 33A is supplied to device 23 to control the read and write control operations thereof with respect to data contained on data lines D0, D1 . . . D7 and DATEN 61C is supplied to synchronize the read and write operations of device 23 with the instruction processing operations of the microprocessor 18.

The interface units 24 through 29 have registers contained therein which are also randomly accessed by the microprocessor 18. A plurality of gating signals denoted by PIA0, PIA1, . . . PIA5 are generated by decoder 76 as governed by the address lines A8, A6, A5, A4, A3 and A2. Each gating signal is supplied to its corresponding interface unit which will be described in more detail herebelow. The signal ZERO 77 is also supplied to all of the interface units 24 through 29. The signal 77 and a corresponding gating signal ensures a distinguishable address for each of the interface units. The control signals 33A and 33B along with the timing signal, $\theta_2$ 61D control the interface units to synchronously present data to or accept data from the data lines D0, . . . D7 in accordance with the read and write operations of the microprocessor 18. Address lines A0 and A1 provide additional addressing information for each of the registers contained in the interface units 24 through 29. Additionally, an interrupt request line (IRQ) 33C and initialization signal line 65 are included with the signals applied to the interface units. A description in more detail is formed herebelow for each of the interface circuits.

The memory modules 19, 20, 21 and 22 may contain instructions and data in the form of 8-bit words in an addressable order so as to characterize the operation of the turbine speed controller 1. The addressable order of the programmable memory registers of the memory modules 19, 20, 21 and 22 are organized from the highest address (i.e. A0 through A15 are all logical true) down. A true signal, FXXX, 80 is generated by AND gate 81 only when all of its inputs, A12, A13, A14 and A15, are logically true. A low true signal, RDFX, 82 is generated by NAND gate 83 only when all of its inputs, DATEN 61C, R/W 33A, and FXXX 80, are logically true. The signal, RDFX, 82 along with buffered address lines A11 and A10 are coupled to each memory module 19, 20, 21 and 22 to provide the distinguishing address, control and timing required to generate the 8-bit programmed instructions and data words over the data lines D0, D1 . . . D7 synchronous with the processing operations of the microprocessor 18. Additional buffered address lines A8, A7, . . . , A0 select the desired register in each of the memory modules 19, 20, 21 and 22.

The address, control and timing lines are buffered by conventional inverter gates 84 so as not to load down their driving sources. The inverted address, control and timing signals provide an extension to the address bus 31, control bus 33 and timing signals 61. The data bus 32 may be bidirectionally buffered by a set of conventional data bus transceivers 85 of the type manufactured by Motorola, Model No. 8T26. The output of the data bus transceivers 85 is the extended data bus 32. The direction of data conducted through the data bus transceiver 85 is controlled by a signal (denoted by RE · DE) 86 which is produced by NAND gate 87. The NOR gate 88 generates a true signal 89 when neither signal, ZERO, 77 nor signal, FXXX, 80 are true. Signal 89 being true is an indication that the address requested by the microprocessor 18 is within a given address range. The signal 86 is affected low by NAND gate 87 to allow data to be read from the extended data bus through the data bus transceiver 85 at times when signal, DATEN, 61C and R/W 33A are true and signal 89 indicates address is within the given address range. Otherwise, signal 86 is affected high by NAND gate 87 permitting data to be written out to the extended bus through data bus transceivers 85.

Figure 3:
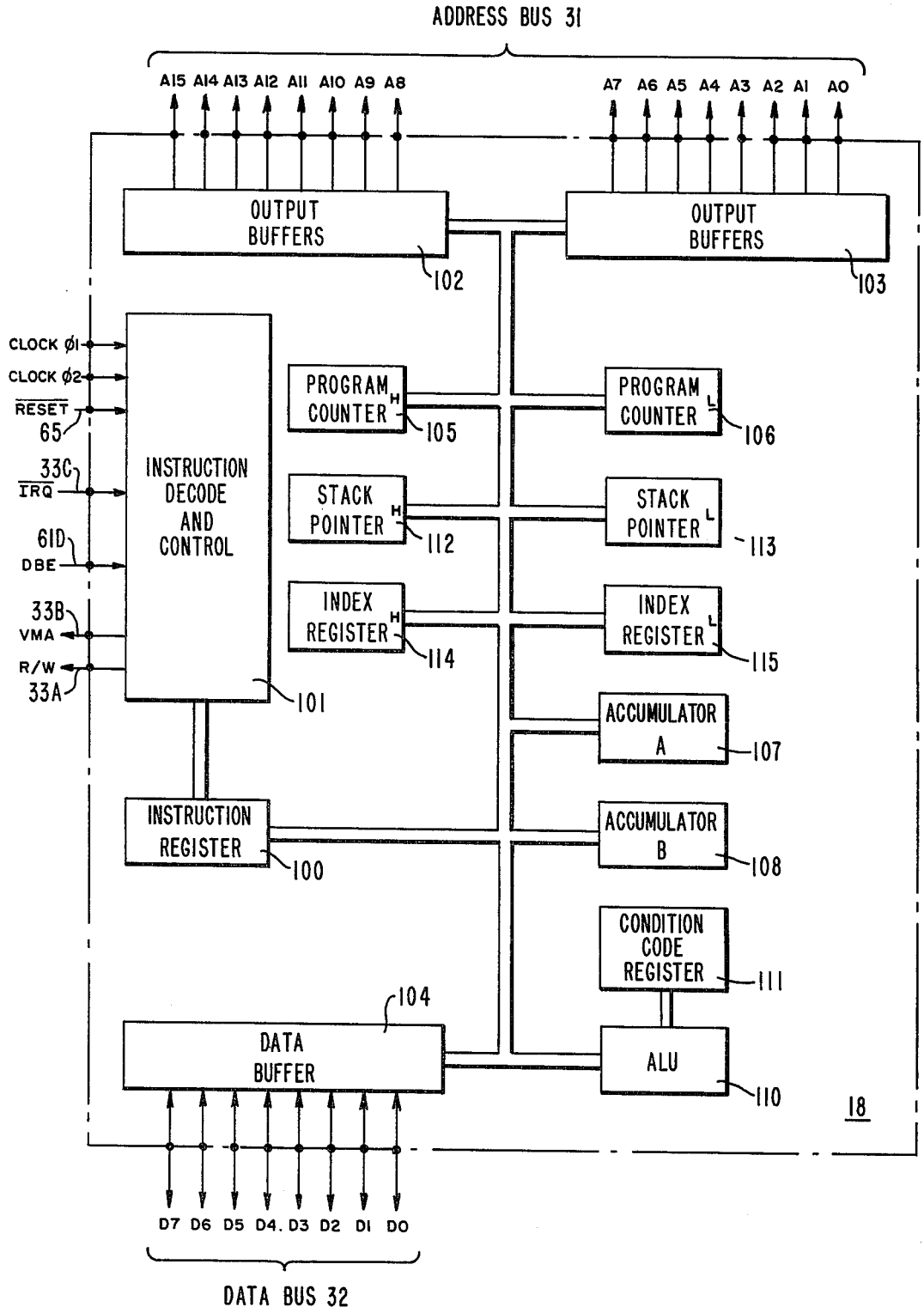
FIG. 3 is a functional block diagram of a typical microprocessor suitable for use in the embodiment of FIG. 1.

The microprocessor 18 suitable for use in this embodiment may be that of the M6800 manufactured by Motorola which is shown functionally in FIG. 3. Typically, the microprocessor 18 is a large scale integrated circuit fabricated in a standard 40 pin dual-in-line package. Microprocessors of this variety are generally controlled by a two phase clock, $\theta_1$ and $\theta_2$, to sequentially process instructions contained in an instruction register 100 using an instruction decode and control circuitry 101 designed for those purposes. The control circuitry 101 controls the output buffers 102 and 103 and bidirectional data input buffers 104. The program counter 105 and 106 always contains the address of the register containing the next instruction to be processed and may be provided to the output buffers 102 and 103 only during a $\theta_2$ clock pulse. The program counter 105 and 106 is either advanced sequentially or controlled to jump or branch to another register address by the control circuit 101 as directed by the present instruction word being processed. Data word DO, D1, . . . D7 contained in the addressed register may be read in through data buffers 104 and entered into the appropriate accumulator register A 107 or register B 108. Likewise, data words contained in either 107 or 108 may be written out through data buffers 104 to the addressed register designated by output buffers 102 and 103. Accordingly, arithmetic and logical operations may be performed by an arithmetic logic unit (ALU) 110 as controlled by specific instructions decoded by circuit 101. Status of the results of the ALU operation are contained in a condition code register 111. A stack pointer register 112 and 113 is provided to store the address of a register in memory which represents a reference point from which data may be stored or recalled in a sequential order. As an example, in response to an interrupt request (IRQ) 33C, certain register contents of the microprocessor 18 are stored in temporary storage memory 23 in a predetermined order using the stack pointer as a reference point. After the interrupt request 33C has been serviced and associated instructions processed by the microprocessor 18, the register contents are recalled in the same order to their respective registers within the microprocessor 18 again using the stack pointer as a reference address point. The microprocessor 18 may continue to process instructions with no disturbing effects as a result of the IRQ 33C except that of a time delay. Another register generally employed by microprocessors is an index register 114 and 115 which is usually used for address indexing purposes, but may be used for temporary storage on occasion. For a more detailed description of the microprocessor 18 refer to "M6800 Systems Reference and Data Sheets"; published by Motorola Semiconductor Products, Inc.; 1975; pp. 9 to 22.

Figure 4:
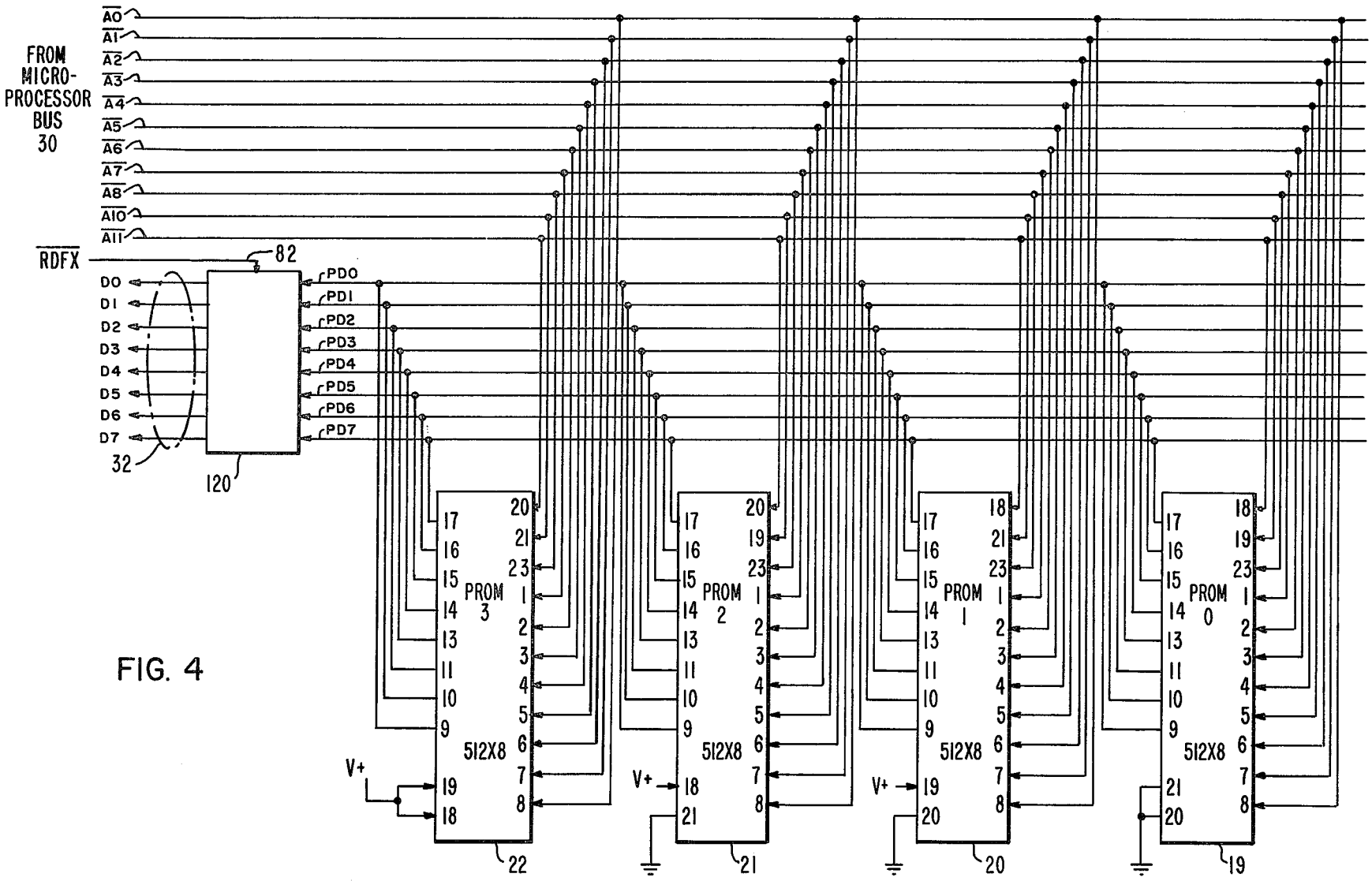
FIG. 4 is a more detailed schematic of an addressing arrangement for a set of permanently programmable memory devices suitable for use in the embodiment of FIG. 1.

Referring to FIG. 4, the memory devices 19, 20, 21 and 22 are interconnected to the microprocessor bus 30 such that each register contained therein has an address assignment distinguishable from all other registers. Suitable memory devices 19, 20, 21 and 22 used for purposes of this embodiment are similar the type manufactured by INTEL Corp; Model No. 3604, each having 512 8-bit words of programmable read-only-memory (PROM). The memory devices 19, 20, 21 and 22 correspond to the PROM notation of PROMO, PROM1, PROM2 and PROM3, respectively. The address lines A11 and A10 are distributed to selected inputs of each memory device 19 through 22 to supply a digital code which enables the memory device addressed by the digital code to output a data word from an addressed register contained therein. The INTEL PROMS type 3604 have 2 chip select inputs CS3 and CS4 which must be logically true and 2 chip select inputs CS1 and CS2 which must be logically false for enabling the output data word buffers contained therein. The PROM memory device address assignments are defined by the following table:

| PROM Chip Select | PROM Pin No. | PROM Connection 3 | 2 | 1 | 0 |
|---|---|---|---|---|---|
| $\overline{CS1}$ | 21 | $\overline{A10}$ | GND | $\overline{A10}$ | GND |
| $\overline{CS2}$ | 20 | $\overline{A11}$ | $\overline{A11}$ | GND | GND |
| CS3 | 19 | $V^+$ | $\overline{A10}$ | $V^+$ | $\overline{A10}$ |
| CS4 | 18 | $V^+$ | $V^+$ | $\overline{A11}$ | $\overline{A11}$ |

The address lines A0 through A8 are also distributed to each of the memory devices 19 through 22 for addressing the desired register in the PROM device 19, 20, 21 or 22 selected by address lines A11 and A10.

Normally binary addressing is denoted in hexadecimal code which is derived from the grouping of 4 bits of binary code and ranges from the decimal number 0 to the letter F wherein the letter A denotes decimal 10, B denotes 11 and so on to letter F which denotes 15. For example, the binary code for decimal 7 is 0111 with its hexadecimal code being also 7, however the binary code 1011 for the decimal number 11 is denoted by hexadecimal code B. A 16-bit binary address of 1111 1111 1111 1111 may be denoted in hexadecimal code by FFFF and a binary address of 1111 1110 0000 0000 may be denoted by a hexadecimal code FE00, as further examples. The binary address codes for the individual PROM devices may be assigned using a hexadecimal code. One possible range of address assignments from the PROM devices which assumes that the A9 address bit is maintained in a logical true state is furnished in the table below:

| PROM | Address Range (hexadecimal code) |
|---|---|
| 3 | FE00 through FBFF |
| 2 | FA00 through FBFF |
| 1 | F600 through F7FF |
| 0 | F200 through F3FF |

As a register of the PROM devices 19 through 22 is addressed by the microprocessor 18, the programmed date word contained therein is provided to the bus consisting of data lines PDO, PD1, . . . PD7 which are connected to a set of digital buffering gates 120 similar to those manufactured by Texas Instruments, Inc.; Model No. 74367. The data word contained on lines PD0, PD1, . . . PD7 is gated to the data bus 32 only at times when signal, RDFX, 82 is logically true.

The INTEL 3604 PROM's used in this embodiment are fabricated in standard 24 pin dual-in-line packages (DIP). Corresponding 24 pin DIP sockets may be used to connect the PROM devices to the printed circuit interconnections of the speed controller 1. A set of one or more of the PROM devices may be permanently programmed with a plurality of addressably ordered, digitally coded instructions and data words for characterizing the operation of the speed controller 1. The set of one or more permanently programmed PROM devices establishes a fixed hardware structure. Another set of one or more PROM devices could also be programmed offering another characterization of speed controller operation and this other set could replace the existing set of PROM devices by inserting them in their corresponding 24 pin DIP sockets. It is apparent, then, that any number of sets of one or more programmed PROM devices 19 through 22 may be inserted into their corresponding 24 pin DIP sockets and, whereby each set may offer a different characterization of the operation of the speed controller 1.

Figure 5:
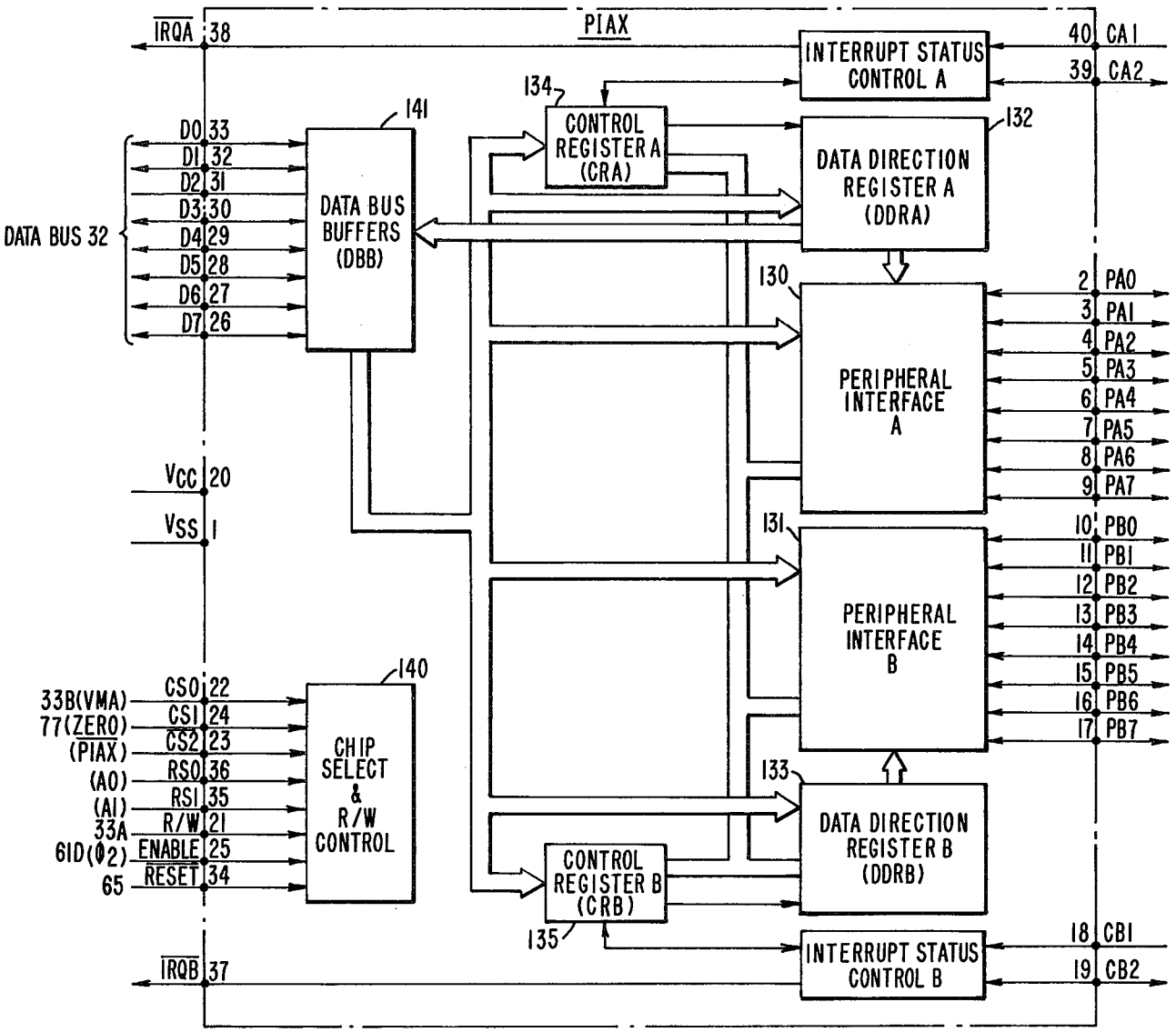
FIG. 5 is a functional block diagram of a typical peripheral interface unit suitable for use in the embodiment of FIG. 1.

The interface units 24 through 29 used in the embodiment described in connection with FIG. 1 are similar to those manufactured by Motorola Semiconductor Products, Inc; "Peripheral Interface Adapters" (PIA); Model No. MC6820. A functional block diagram of a typical interface unit 24 through 29 is shown in FIG. 5. This conventional PIA device is contained on a large scale integrated circuit which is fabricated in a standard 40 pin dual-in-line package (DIP). The pinning interconnections are shown in FIG. 5. The interface units 24 through 29 provide programmed communication between the bidirectional data bus 32 of the microprocessor 18 and the input and output digital data conditioning circuits as controlled by a selected number of address, timing and control signals. The structure of a typical PIA is divided into an A and B section. Each section comprises a bidirectional 8-bit peripheral data bus PA0 through PA7 and PB0 through PB7 each connected to its respective peripheral interface register (PIR) 130 and 131. A data direction register (DDR) 132 and 133 is included for each section A and B to program the direction in which data flows over the A and B peripheral buses. Programmable control registers 134 and 135 are included for each section A and B to allow the microprocessor 18 to control the operation of the four peripheral control lines CA1, CA2, CB1, and CB2. The word formats of the control registers A and B are final in the following table:

| Programmable Control Register Word Format | | | | | | | |
|---|---|---|---|---|---|---|---|
| BITS | 7 | 6 | 5 4 3 | 2 | 1 | 0 |
| CRA (134) | IRQA1 | IRQA2 | CA2 Control | DDRA Access | CA1 | Control |
| CRB (135) | IRQB1 | IRQB2 | CB2 Control | DDRB Access | CB1 | Control |

The peripheral control lines CA1 abd CB1 are mainly used as interrupt inputs, the control of which is programmed into bit 0 and bit 1 of their respective programmable control register. Control lines CA1 and CB1 are designed to set their respective interrupt flags, CRA bit 7 and CRB bit 7, in response to a transition either from high to low or from low to high thereof. The interrupt request lines IRQA and IRQB may under certain conditions be "OR"ed together and connected to the interrupt request line, IRQ, 33C of the microprocessor 18. Each interrupt request, IRQA and IRQB, is set true and false in response to its corresponding interrupt flag, CRA bit 7 and CRB bit 7, being set true and false, respectively. The programming of the peripheral control lines may be described in the following table and supplemental notes:

| CONTROL OF INTERRUPT INPUTS CA1 AND CB1 | | | | |
|---|---|---|---|---|
| BIT 1 CRA (CRB) | BIT 0 CRA (CRB) | Interrupt Input CA1 (CB1) | Interrupt Flag CRA-7 (CRB-7) | MPU Interrupt Request IRQA (IRQB) |
| 0 | 0 | ↓ Active | Set high on ↓ of CA1 (CB1) | Disabled - IRQ remains high |
| 0 | 1 | ↓ Active | Set high on ↓ of CA1 (CB1) | Goes low when the interrupt flag bit CRA-7 (CRB-7) goes high |
| 1 | 0 | ↑ Active | Set high on ↑ of CA1 (CB1) | Disabled - IRQ remains high |
| 1 | 1 | ↑ Active | Set high on ↑ of CA1 (CB1) | Goes low when the interrupt flag bit CRA-7 (CRR-7) goes high |

-continued

Notes:
1. ↑ Indicates positive transition (low to high)
2. ↓ Indicates negative transition (high to low)
3. The Interrupt flag bit CRA-7 is cleared by an MPU Read of the A Data Register, and CRB-7 is cleared by an MPU Read of the B Data Register.
4. If CRA-0 (CRB-0) is low when an interrupt occurs (Interrupt disabled) and is later brought high, IRQA (IRQB) occurs on the positive transition of CRA-0 (CRB-0).

The remaining peripheral control lines CA2 abd CB2 may be used as either an interrupt input or a control line output as programmed by CRA bit 5 and CRB bit 5. The programming of peripheral control lines CA2 abd CB2 as interrupt input using the control registers CRA 134 and CRB 135 of FIG. 5 may best be presented by the following table and supplemental notes:

| CONTROL OF CA2 AND CB2 AS INTERRUPT INPUTS CRA5 (CRB5) is low | | | | | |
|---|---|---|---|---|---|
| BITS CRA (CRB) | BIT 4 CRA (CRB) | BIT 3 CRA (CRB) | Interrupt Input CA2 (CB2) | BIT 6 Interrupt Flag CRA (CRB) | MPU Interrupt Request IRQA (IRQB) |
| 0 | 0 | 0 | ↓ Active | Set high on ↓ of CA2 (CB2) | Disabled - IRQ remains high |
| 0 | 0 | 1 | ↓ Active | Set high on ↓ of CA2 (CB2) | Goes low when the interrupt flag bit CRA-6 (CRB-6) goes high |
| 0 | 1 | 0 | ↑ Active | Set high on ↑ of CA2 (CB2) | Disabled - IRQ remains high |
| 0 | 1 | 1 | ↑ Active | Set high on ↑ of CA2 (CB2) | Goes low when the interrupt flag bit CRA-6 (CRB-6) goes high |

Notes:
1. ↑ Indicates positive transition (low to high)
2. ↓ Indicates negative transition (high to low)
3. The interrupt flag bit CRA-6 is cleared by an MPU Read of the A Data Register and CRB-6 is cleared by an MPU Read of the B Data Register.
4. If CRA-3 (CRB-3) is low when an interrupt occurs (Interrupt disabled) and is later brought high, IRQA (IRQB) occurs on the positive transition of CRA-3 (CRB-3).

The programming of peripheral control line CA2 as an output using the control register (CRA) 134 of FIG. 5 may be described in connection with the following table:

| CONTROL OF CA2 AS AN OUTPUT CRA-5 is high | | | | |
|---|---|---|---|---|
| BIT 5 CRA | BIT 4 CRA | BIT 3 CRA | Cleared | Set |
| 1 | 0 | 0 | Low on negative transition of E after an MPU Read "A" Data operation. | High on an active transition of the CA1 signal. |
| 1 | 0 | 1 | Low immediately after an MPU Read "A" Data operation. | High on the negative edge of the next "E" pulse. |
| 1 | 1 | 0 | Low when CRA-3 goes low as a result of an MPU Write in Control Register "A". | Always low as long as CRA-3 is low. |
| 1 | 1 | 1 | Always high as long as CRA-3 is high. | High when CRA-3 goes high as a result of a Write in Control |

-continued

| CONTROL OF CA2 AS AN OUTPUT CRA-5 is high | | | | |
|---|---|---|---|---|
| BIT 5 CRA | BIT 4 CRA | BIT 3 CRA | Cleared | Set |
| | | | | Register "A". |

Notes:
1. E is representative of the $\phi_2$ clock connected to the enable input of the PIA in Figure 5.
2. MPU refers to microprocessor 18.

The programming of peripheral control line CB2 as an output using the control register (CRB) 134 shown in FIG. 5 may be described best in connection with the following table:

| CONTROL OF CB2 AS AN OUTPUT CRB-5 is high | | | | |
|---|---|---|---|---|
| CRB -5 | CRB -4 | CRB -3 | Cleared | Set |
| 1 | 0 | 0 | Low on the positive transition of the first E pulse following an MPU Write "B" Data Register operation. | High when the interrupt flag bit CRB-7 is set by an active transition of the CB1 signal. |
| 1 | 0 | 1 | Low on the positive transition of the first E pulse following an MPU Write "B" Data Register operation. | High on the positive transition of the next "E" pulse. |
| 1 | 1 | 0 | Low when CRB-3 goes low as a result of an MPU Write in Control Register "B". | Always low as CRB-3 is low. Will go high on an MPU Write in Control Register "B" that changes CRB-3 to "one". |
| 1 | 1 | 1 | Always high as long as CRB-3 is high. Will be cleared when an MPU Write Control Register "B" results in clearing CRB-3 to "zero". | High when CRB-3 goes high as a result of an MPU write into control register "B". |

Figure 6:
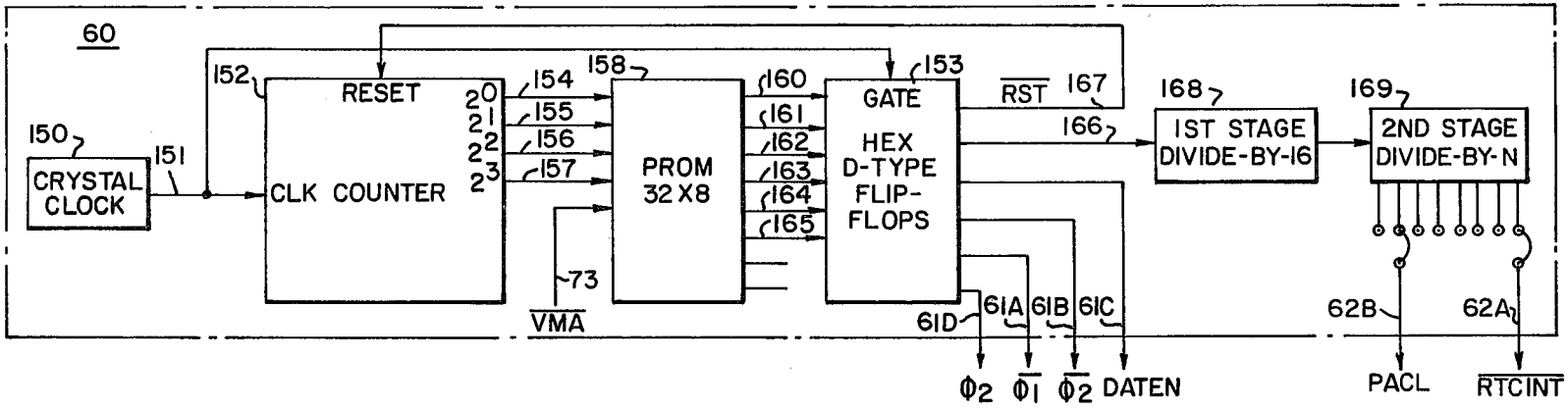
FIG. 6 is a more detailed schematic block diagram of a system and real time clock generator suitable for use in the embodiment of FIG. 1.

Each PIA interface unit 24 through 29 is selectively addressed by satisfying the requirements of its chip select input which are shown in FIG. 6 as CS0, CS1 and CS2 and connected thereto are VMA, signal 33B; ZERO, signal 77; and PIAX, respectively. The signal PIAX represents one of the decoded signals PIAO, PIA1, . . . PIA5 corresponding to each of the PIA interface units shown in connection with FIG. 1. The decoder 76 of FIG. 2 is similar to a 74LS 138 integrated circuit manufactured by Texas Instrument, Inc. The decoding by the decoder 76 to produce each of the gating signals PIA0, PIA1, . . . PIA5 may be performed in accordance with the following table:

| INPUTS | | | | | | TRUE OUTPUT |
|---|---|---|---|---|---|---|
| A8 | A6 | A5 | A4 | A3 | A2 | All other output signals false |
| 1 | 0 | 0 | 0 | 0 | 0 | $\overline{PIA0}$ |
| 1 | 0 | 0 | 0 | 0 | 1 | $\overline{PIA1}$ |
| 1 | 0 | 0 | 0 | 1 | 0 | $\overline{PIA2}$ |
| 1 | 0 | 0 | 0 | 1 | 1 | $\overline{PIA3}$ |
| 1 | 0 | 0 | 1 | 0 | 0 | $\overline{PIA4}$ |
| 1 | 0 | 0 | 1 | 0 | 1 | $\overline{PIA5}$ |

The six internal registers of the PIA interface unit shown in FIG. 5 are addressed using the inputs RSO and RS1 thereof and the state of bit 2 of the two control registers CRA and CRB contained therein. The addressing combinations are shwon in the table below:

| INTERNAL ADDRESSING | | | | |
|---|---|---|---|---|
| (A1) RS1 | (A0) RS0 | Control Register Bit CRA-2 | Control Register Bit CRB-2 | Location Selected |
| 0 | 0 | 1 | X | Peripheral Register A (130) |
| 0 | 0 | 0 | X | Data Direction Register A (132) |
| 0 | 1 | X | X | Control Register A (134) |
| 1 | 0 | X | 1 | Peripheral Register B (131) |
| 1 | 0 | X | 0 | Data Direction Register B (133) |
| 1 | 1 | X | X | Control Register B (135) |

X = Don't Care.

Address lines A0 and A1 are respectively connected to the RS0 and RS1 inputs of all of the PIA interface units 24 through 29 to control the addressing of their internal registers. Therefore, the combination of address signals ZERO, 77; PIAX (i.e. one of the decided signal PIA0, . . . PIA5); and A0 and A1, provide an address assignment for each of the necessary internal registers of the interface units 24 through 29. Assuming that bit A7 is maintained logically false, a possible set of internal register address assignments in hexadecimal code are tabulated in the following table:

| Interface Unit | PIA0 | A Side Assigned Addresses *DDR or PR | A Side Assigned Addresses CR | B Side Assigned Addresses *DDR or PR | B Side Assigned Addresses CR |
|---|---|---|---|---|---|
| 27 | 0 | 0100 | 0101 | 0102 | 0103 |
| 28 | 1 | 0104 | 0105 | 0106 | 0107 |
| 24 | 2 | 0108 | 0109 | 010A | 010B |
| 25 | 3 | 010C | 010D | 010E | 010F |
| 26 | 4 | 0110 | 0111 | 0112 | 0113 |
| 29 | 5 | 0114 | 0115 | 0116 | 0117 |

Notes:
1. All assigned addresses are in hexadecimal code;
2. DDR = data direction register; PR = peripheral register; CR = control register;
3. (*) DDR and PR address is additionally determined by bit 2 of the corresponding control register.

The timing signals $0_2$, 61D and VMA, 33B; control signals R/W, 33A; and address assignment signals ZERO, 77; PIAX; A0 and A1 are connected to a Chip Select and R/W Control circuit 140 of ech of the PIA interface units 24 through 29 to permit data words to be conducted through the Data Bus Buffers (DBB) 141 of the interface units 24 through 29 between the Data Bus 32 and the internal registers contained therein. In addition, the initialization signal 65 is connected to the RESET input of the Chip Select and R/W Control circuit 140 for clearing all of the internal registers contained in each of the interface units during the initialization pulse generation of the signal 65 upon power-on initialization as described hereabove. Reference is made herein to the "M6800 Systems Reference and Data Sheets"; pp. 23 to 30; for a more detailed description of a typical PIA interface unit.

A typical operation of programmed communication between the microprocessor 18 and one of the interface units to initialize the internal registers therein may be as follows. After the internal registers of the interface units 24 through 29 have been cleared by the signal 65, bit 2 of each of the control registers contained therein is in a state to permit addressing of the DDR's 132 and 133 (i.e. a binary "0" state). The address assignments of the DDR 132, the data word to be programmed into the DDR 132 and a write control state is presented concurrently to the interface unit using the appropriate bus line connected thereto as previously described. The DDR 132 data word is written into the DDR 132 register during a $\theta_2$ clock pulse over signal line 61D connected to the Enable input of the PIA device. Each bit in the DDR 132 controls the input or output data flow from a corresponding data line of the peripheral bus PAO, . . . PA7 utilizing the peripheral interface register A 130. A binary "1" state of a bit in the DDR 132 programs its corresponding peripheral bus line to only be an output (i.e. to permit data to be written out or flow out only) and a binary "0" state of a bit in the DDR 132 programs its corresponding peripheral bus line to only be an input (i.e. to permit data to be read in or flow in only). A similar programming operation may be performed on DDR 133 to control the flow of data over its peripheral data bus PB0, . . . PB7 utilizing the peripheral interface register B 131. Next, the control register 134 is programmed concurrently by presenting its address assignment and data word and a write control state over the appropriate bus lines. The CR data word is written into the CR 134 during a $\theta_2$ clock pulse. Similarly, CR 135 may be programmed next in sequence. The peripheral register 130 may be initialized only if the bit 2 of CR 134 is programmed with a binary "1" state. Again, the assigned address and data word for the PR 130 is presented to the approriate bus lines including a write control state and with the $\theta_2$ clock pulse, the PR data word is written into the PR 130. Accordingly, the PR 131 may be updated in a similar manner. It is understood that the microprocessor 18 in controlling the communication between itself and a PIA interface unit over the microprocessor bus 30 is governed by instructons and data words contained in the memory devices 19 through 22 which are addressably sequenced by the 2-phase clock signals, 61A and 61B ($\theta_1$ and $\theta_2$). In this embodiment, data words may only be conducted over the microprocessor bus 30 during the $\theta_2$ clock pulses. It is also possible to read in data words from each of the internal registers of the PIA interface units by performing similar operations as described above except presenting a read control state over signal line 33A (R/W).

The system and real time clock generator 60 is shown in greater detail in FIG. 6. A variety of timing signals generated thereby are disposed within the microprocessor based controller 1 to ensure synchronous and proper operation thereof. The source of the various timing signals may be that of a crystal clock 150 similar to that manufactured by Motorola; Model No. K1091A. A suitable frequency for the purposes of this embodiment was approximately $2^{23}$ HZ. A clock signal 151 is coupled to a 4-bit synchronous counter 152 and to a common gating input of a package containing six D-type flip-flops 153. The four output signals 154 ($2^0$), 155 ($2^1$), 156 ($2^2$) and 157 ($2^3$) of the synchronous counter 152 along with the VMA signal 73 are inputs to a programmable read only memory (PROM) 158. The frequency and phase relationships of the output timing signals 160, 161, . . . , 165 of the PROM 158 are characterized by the microprogram contained therein. The signals 160, 165 are coupled to the package of hex D-type flip-flops 153 wherein each signal is correspondingly connected to a data input of the D type flip-flops thereof to generate the signals RST, 167; RTC, 166; DATEN, 61C; $\theta_2$, 61B; $\theta_1$, 61A; and $\theta_2$, 61D, respectively. The signal RST, 167 is coupled to the reset input of the counter 152. Also, the signal 166, RTC, is coupled to a divide-by-16 counter 168 which is in cascade with a 12-stage counter 169. The counter 169 yields clock signals of binarily separated frequencies of which one is selected as the signal, PACL, 62B and another is selected as the signal, RTCINT, 62A.

The PROM 158 may be of the type manufactured by Intersil; Model No. IM5600 which contains programmable storage registers for 32 8-bit data words wherein each storage register corresponds to an input 5-bit address. A typical program for the PROM 158 is shown in Table 1 below wherein only 6 of the 8 bits of each storage register are used in this embodiment. As each address is sequentially generated by the synchronous counter (typically a 74163), the output states of the signals 160, 161, . . . 165 respond directly thereto. The data words may also be accessed by jumping from one addressable sequence of operation to another, say for example, those addresses which are between binary 0 to 11, as one sequence, and those addresses which are between binary 16 to 27, as another, in accordance with the state of the VMA signal 73.

TABLE 1

| INPUTS | | | | | OUTPUTS | | | | | | |
|---|---|---|---|---|---|---|---|---|---|---|---|
| $\overline{VMA}$ | $2^3$ | $2^2$ | $2^1$ | $2^0$ | Signal | 160 | 161 | 162 | 163 | 163 | 165 |
| 0 | 0 | 0 | 0 | 0 | | 1 | 0 | 0 | 1 | 0 | 0 |
| 0 | 0 | 0 | 0 | 1 | | 1 | 0 | 0 | 1 | 0 | 0 |
| 0 | 0 | 0 | 1 | 0 | | 1 | 1 | 0 | 1 | 0 | 0 |
| 0 | 0 | 0 | 1 | 1 | | 1 | 1 | 0 | 1 | 0 | 0 |
| 0 | 0 | 1 | 0 | 0 | | 1 | 0 | 0 | 1 | 0 | 0 |
| 0 | 0 | 1 | 0 | 1 | | 1 | 0 | 0 | 1 | 1 | 0 |
| 0 | 0 | 1 | 1 | 0 | | 1 | 1 | 1 | 0 | 1 | 1 |
| 0 | 0 | 1 | 1 | 1 | | 1 | 1 | 1 | 0 | 1 | 1 |
| 0 | 1 | 0 | 0 | 0 | | 1 | 0 | 1 | 0 | 1 | 1 |
| 0 | 1 | 0 | 0 | 1 | | 1 | 0 | 1 | 0 | 1 | 1 |
| 0 | 1 | 0 | 1 | 0 | | 0 | 1 | 1 | 0 | 1 | 1 |
| 0 | 1 | 0 | 1 | 1 | | 1 | 1 | 0 | 1 | 1 | 0 |
| 0 | 1 | 1 | 0 | 0 | | 0 | 1 | 0 | 1 | 1 | 0 |
| 0 | 1 | 1 | 0 | 1 | | 0 | 1 | 0 | 1 | 1 | 0 |
| 0 | 1 | 1 | 1 | 0 | | 0 | 1 | 0 | 1 | 1 | 0 |
| 0 | 1 | 1 | 1 | 1 | | 0 | 1 | 0 | 1 | 1 | 0 |
| 1 | 0 | 0 | 0 | 0 | | 1 | 0 | 0 | 1 | 0 | 0 |
| 1 | 0 | 0 | 0 | 1 | | 1 | 0 | 0 | 1 | 0 | 0 |
| 1 | 0 | 0 | 1 | 0 | | 1 | 1 | 0 | 1 | 0 | 0 |
| 1 | 0 | 0 | 1 | 1 | | 1 | 1 | 0 | 1 | 0 | 0 |
| 1 | 0 | 1 | 0 | 0 | | 1 | 0 | 0 | 1 | 0 | 0 |
| 1 | 0 | 1 | 0 | 1 | | 1 | 0 | 0 | 1 | 1 | 0 |
| 1 | 0 | 1 | 1 | 0 | | 1 | 1 | 0 | 0 | 1 | 1 |
| 1 | 0 | 1 | 1 | 1 | | 1 | 1 | 0 | 0 | 1 | 1 |
| 1 | 1 | 0 | 0 | 0 | | 1 | 0 | 0 | 0 | 1 | 1 |
| 1 | 1 | 0 | 0 | 1 | | 1 | 0 | 0 | 0 | 1 | 1 |
| 1 | 1 | 0 | 1 | 0 | | 0 | 1 | 0 | 0 | 1 | 1 |

TABLE 1-continued

| INPUTS | | | | | OUTPUTS | | | | | | |
|---|---|---|---|---|---|---|---|---|---|---|---|
| $\overline{VMA}$ | $2^3$ | $2^2$ | $2^1$ | $2^0$ | Signal | 160 | 161 | 162 | 163 | 163 | 165 |
| 1 | 1 | 0 | 1 | 1 | | 1 | 1 | 0 | 1 | 1 | 0 |
| 1 | 1 | 1 | 0 | 0 | | 0 | 1 | 0 | 1 | 1 | 0 |
| 1 | 1 | 1 | 0 | 1 | | 0 | 1 | 0 | 1 | 1 | 0 |
| 1 | 1 | 1 | 1 | 0 | | 0 | 1 | 0 | 1 | 1 | 0 |
| 1 | 1 | 1 | 1 | 1 | | 0 | 1 | 0 | 1 | 1 | 0 |

Figure 7:
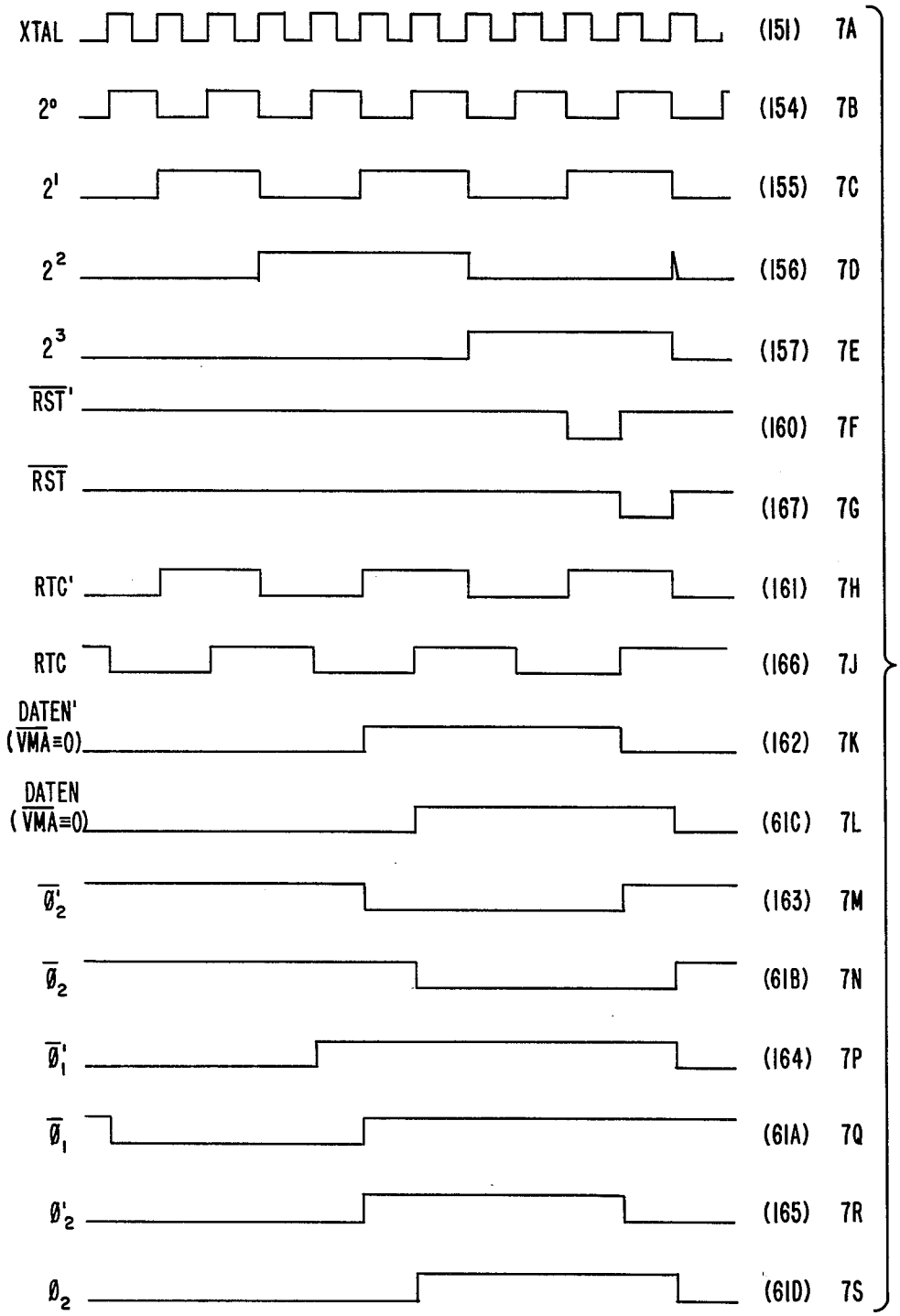
FIG. 7A through 7H, 7J through 7N and 7P through 7S are waveforms illustrating the operation of the system and real time clock generator of FIG. 6.

A typical operation of the clock circuit 60 may be described as follows. A clock 151 is generated by the crystal clock 150 similar to that shown in FIG. 7A. The rising edge of each of the clock pulse of 151 governs the change in the state of the output signals 154, . . . , 157 of the counter 152 as shown in FIGS. 7B, 7C, 7D and 7E, respectively. The outputs of PROM 158 respond to the changing state of its inputs 154, . . . , 157 and VMA, 73 by producing the waveforms shown in FIGS. 7F, 7H, 7K, 7M, 7P and 7R respectively corresponding to the signals 160, 161, . . . , 165. The state of all the signals 160, . . . , 165 concurrently are gated to the outputs of the D type flip-flops of package 153 at each rising edge of the clock signal 151 as shown in the FIGS. 7G, 7J, 7L, 7N, 7Q and 7S respectively corresponding to the signals (RST) 167, (RTC), 166, (DATEN), 61C, ($\theta_2$) 61B, ($\theta_1$) 61A, and ($\theta_2$) 61D. All of the output signals from 153 are delayed by one clock period of the signal 151 from the output signals of PROM 158. The counter 152 is reset to a binary count of 0000 upon occurrence of the rising edge of the first clock pulse of signal 151 after the signal (RST) 167 is brought to a low state. The signal (DATEN) 61C produces a pulse during the 12 clock pulse period of clock circuit 60 only at times when the signal (VMA) 73 is logically false (i.e., binary "0") during this period, otherwise (DATEN) 73 will remain in a low state. The (RTC) signal 167 is divided down in frequency by the counters 168 and 169 to yield the signal (RTCINT) 62A which may be tapped from the 11th stage of the 12 stage counter 169 providing a frequency of approximately 64 Hz which is suitable for this embodiment, and the signal (PACL) 62B which may be tapped from either the last or second stage of the counter 169 providing frequencies around 65.54 KHz or 37.77 KHz, repsectively. In addition, the clock circuit 60 protects against "overlapping" the low states of signals ($\theta_2$) 61B and ($\theta_1$) 61A in time by providing at least one clock pulse separation therebetween as illustrated in FIGS. 7N and 7Q.

One requirement of the MC6800 microprocessor 18, chosen for this embodiment, is that it must receive an initialization pulse over signal line 65 of a time duration at least including 8 clock pulses of the $\theta_1$ and $\theta_2$ signals to begin instruction processing after the power is turned on and reaches with ±5% of its nominal potential. A power-on initialization circuit 64 is provided to generate a pulse of at least the required duration over signal line 65 to satisfy the requirements of the microprocessor 18. A detailed circuit diagram of the power-on initialization circuit 64 is shown in FIG. 8 and waveforms illustrating the operation therof are shown in FIGS. 8A through 8D.

Figure 8A:
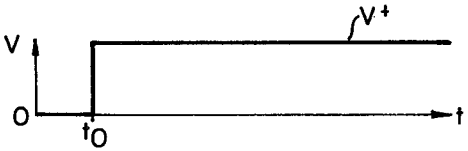
FIGS. 8A through 8D are waveforms illustrating the operation of the power-on initialization circuit of FIG. 8.
Figure 8B:
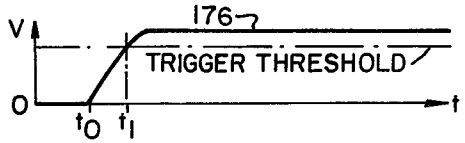
Figure 8C:
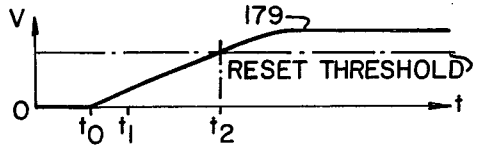
Figure 8D:
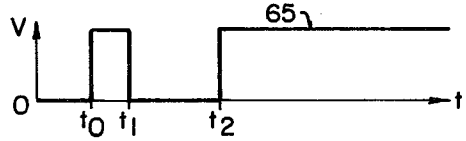
Figure 8:
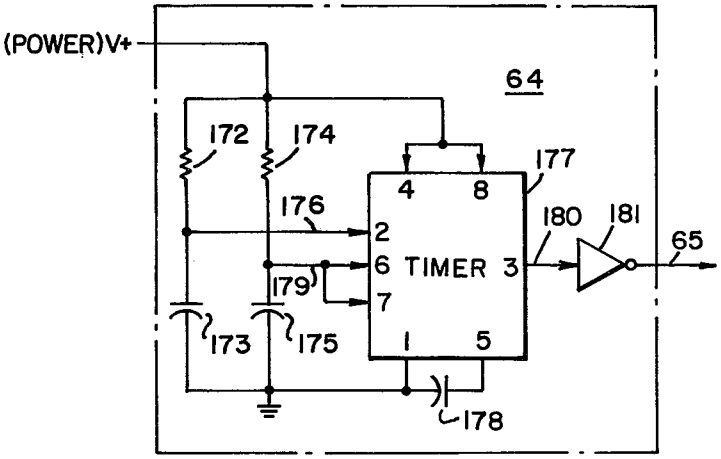
FIG. 8 is a detailed schematic diagram of a power-on initialization circuit suitable for use in the embodiment of FIG. 1.

Referring to FIG. 8, a resistor 172 is connected in series to a capacitor 173 between the power supply bus of potential V+ and ground. Resistor 174 is also connected in series with capacitor 175 between the power supply bus and ground. The connection between resistor 172 and capacitor 173 is connected to pin 2 of an integrated circuit 77 similar to the type manufacture by Signetics Corp; Model 555, over signal line 176. Also, the connection between resistor 174 and capacitor 175 is coupled to pins 6 and 7 of the integrated circuit (IC) 177 over signal line 179. Power is supplied to IC 177 through pins 4 and 8 and ground is provided at pin 1. A capacitor 178 is connected between pin 5 of IC 177 and ground to enhance the rejection of high frequency electrical noise. The output signal 180 of IC 177 is inverted by a conventional inverter circuit 182 to produce signal 65. After power is switched on at time, $t_0$, as shown in FIG. 8A, the potential of signal line 176 increases in accordance with the time constant of resistor 172 and capacitor 173 until it reaches the trigger threshold of the IC 177 at time, $t_1$ as shown in FIG. 8B. At time, $t_1$, the output 180 is affected to a high state in response to the triggering of IC 177 thereby causing the signal 65 to be forced low by inverter 181 (refer to FIG. 8D). Also after the power switch-on at time, $t_0$, the potential of signal 179 increases in accordance with the time constant of resistor 174 and capacitor 175 as shown in FIG. 8C. At time, $t_2$, the potential of signal line 179 reaches a reset threshold potential of IC 177 which causes the signal 180, output of IC 177, to be maintained in a low state thereby affecting signal 65 to a high state as shown in FIG. 8D. The two time constants of circuit 64 are adjusted such that the time duration between $t_1$ and $t_2$ is at least greater than 8 clock pulses of the $\theta_1$ and $\theta_2$ clock signals. For this embodiment, a time duration of 500 milliseconds was found suitable.

Figure 9:
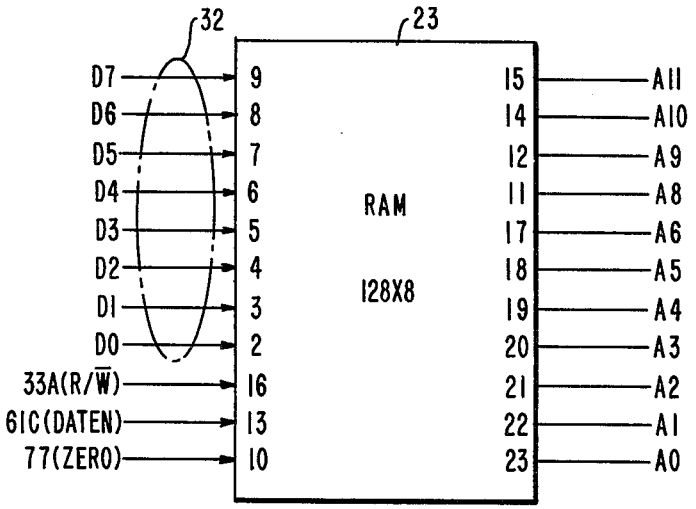
FIG. 9 is a more detailed schematic of a typical temporary storage memory device and its connections to the microprocessor bus which may be suitable for use in the embodiment of FIG. 1.

The temporary storage memory device 23 typically a MCM6810 which is contained on a large scale integrated circuit fabricated in a 24 pin dual-in-line package is shown in FIG. 9. The MCM6810 includes 128 8-bit read/write random access storage locations. To enable data words from data bus 32 connected thereto to be written in or read from the memory 23, the chip select input requirements thereof must be met. The chip select inputs of an MCM6810 and signals connected thereto are shown in the following table:

| Chip Select | MCM6810 Pin No. | Signal Connection |
|---|---|---|
| CS0 | 10 | ZERO ($\overline{A12} \cdot \overline{A13} \cdot \overline{A14} \cdot \overline{A15}$) |
| $\overline{CS1}$ | 11 | A8 |
| $\overline{CS2}$ | 12 | A9 |
| CS3 | 13 | DATEN (VMA · $\phi_2$ TTL) |
| $\overline{CS4}$ | 14 | A10 |
| $\overline{CS5}$ | 15 | A11 |

Thus if the most significant 8-bits A15, . . ., A9 of the address bus 31 are false and DATEN, 61C is true, data words are permitted to flow between the data bus 32 and memory 23. The state of the R/W signal 33A determines the direction of data flow and the state of the address lines A0, A1, . . ., A6 provides the address assignment of the specific register in the memory 23 which is to be accessed.

Figure 10:
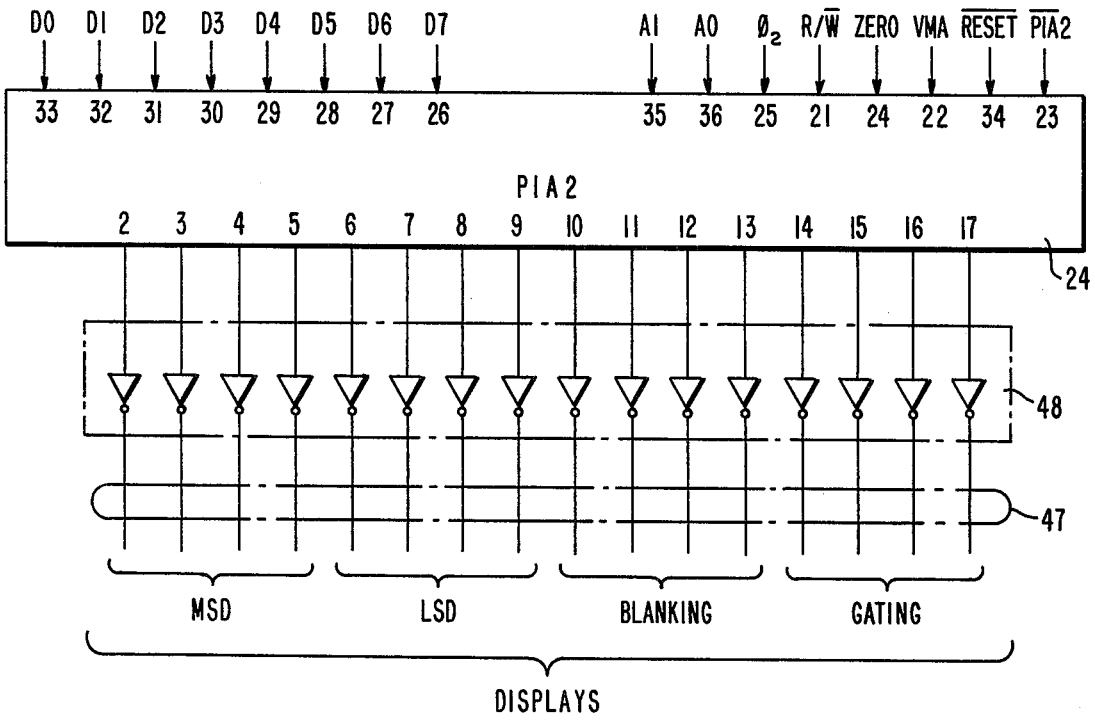
FIG. 10 is a more detailed schematic of a panel display buffer and its interface to the microprocessor bus which may be suitable for use in the embodiment of FIG. 1.

That circuitry of FIG. 1 which may be used to control digital BCD type displays is shown in detail in FIG. 10. The interface unit 24 is similar to that previously described in connection with FIG. 5. The peripheral bus lines of the interface unit 24 are all outputs buffered by conventional inverters 48 similar to that of a 7437 integrated circuit. The inputs to the interface unit (IU) 24 are derived from the microprocessor bus 30 as shown in FIG. 2 and function to control 24 similar to that described in connection with FIG. 5. One possible example of control of a BCD type digital display is to couple those outputs from pins 2, 3, 4, 5 of IU 24 to one digit display having a quad latch memory and to couple those outputs from pins 6, 7, 8, 9 of IU 24 to another digit display adjacent to the first and also having a quad latch memory. One of the signals from pins 14, 15, 16, 17 may be used as the gate input to both of the displays. An 8-bit word contained in the peripheral register of the A section of IU 24 may be gated into two BCD decimal displays having quad latch memory in accordance with the 8-bit data word contained in the peripheral register of the B section of IU 24. The output signals from pins 2, 3, . . ., 9 of the IU 24 may be coupled in parallel to a plurality of sets of BCD displays and data may be gated therefrom into each set of BCD displays corresponding to a gate signal generated by the outputs from pins 10, . . ., 17 of IU 24. A portion of the output signals may also be used to blank certain displays as required. It is understood that this description is only one example of many possibilities of which the display driver circuitry of FIG. 10 may be programmed to function.

Figure 11:
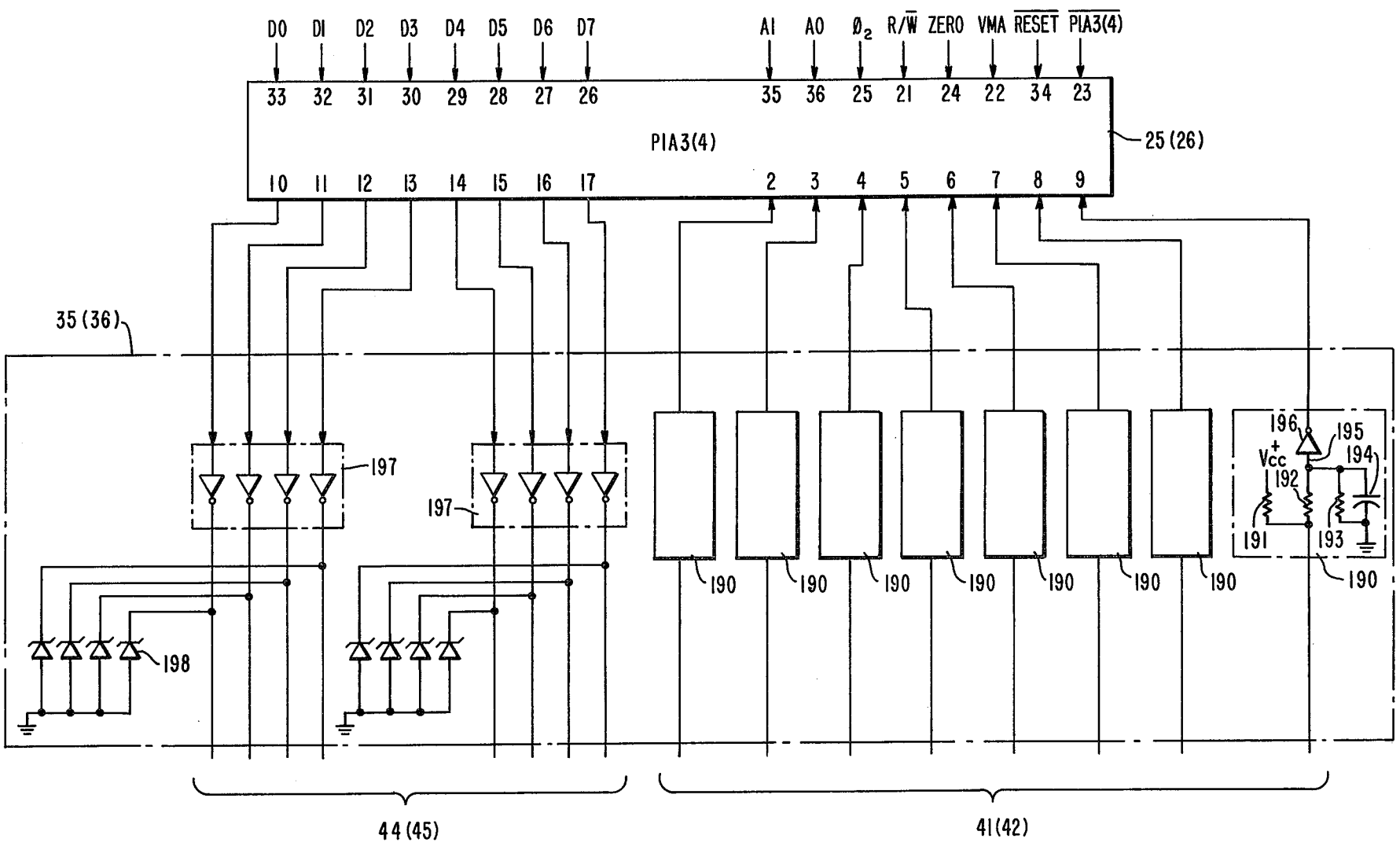
FIG. 11 is a more detailed schematic of a digital I/O conditioning circuit and its interface to the microprocessor bus which may be suitable for use in the embodiment of FIG. 1.

That circuitry of FIG. 1 which is used to monitor digital input signals and control digital output signals is shown in FIG. 11. The peripheral bus lines of section A of the IU 25 (26) are used as inputs and the peripheral bus lines of section B of the IU 25 (36) are used as outputs. The controlling inputs to the interface unit 25 (26) are derived from the microprocessor bus 30 as shown in FIG. 2 and function to control IU 25 (26) similar to that described in connection with FIG. 5. Each input of inputs 41 (42) to the IU 25 (26) is signal conditioned by a circuit 190 comprising a resistor 191 "pull-up" to the power supply $V^+_{cc}$, a resistor divider network, made up of resistor 192 in series with resistor 193, connected between each input and ground for attenuation, a capacitor 193 in parallel with resistor 193 for filtering high frequency electrical noise and an inverter circuit 196 (typically a 4049) having the signal 195 taken from the connection between resistors 192 and 193 as an input. The output of each inverter 196 is provided to the IU 25 (26) to represent the states of the inputs connected to lines 41 (42). Accordingly, each output of the outputs 44 (45) from the IU 25 (26) is buffered by an inverter driver 197 which may be similar to the type manufactured by Signetics Corp.; Model No. 2003A. Zener diodes 198 are connected from the output of each driver 197 to ground for the protection against overvoltage which may be either capacitively or electromagnetically coupled to any of the output lines 44 (45) in the form of "noise spikes".

Figure 11A:
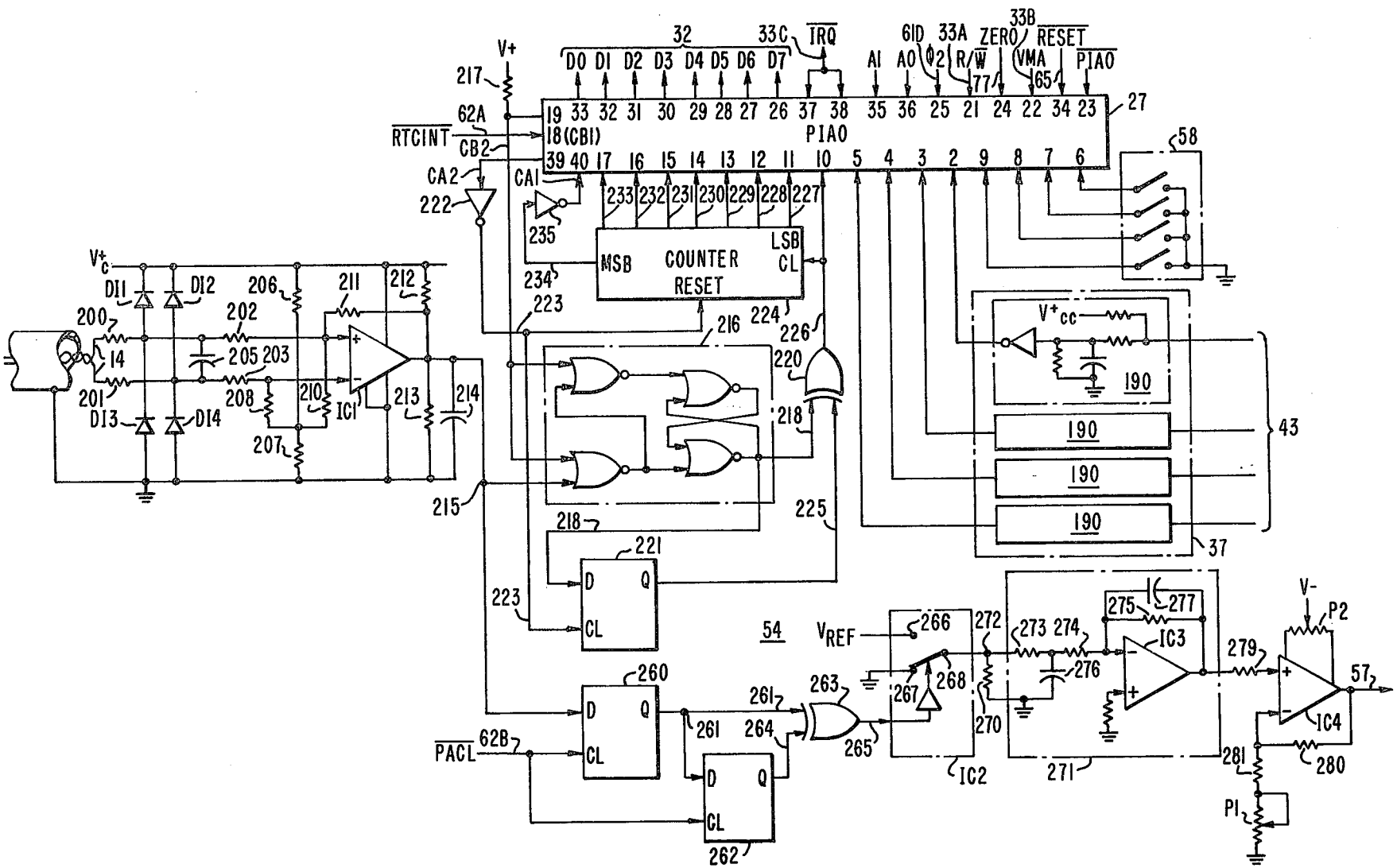
FIG. 11A principally provides a more detailed schematic of a speed monitoring interface suitable for use in the embodiment of FIG. 1.

The speed monitoring interface circuitry 54 of FIG. 1 is shown in greater detail in FIG. 11A. The speed signal 14 is coupled to a pair of balanced resistors 200 and 201 which are, in turn, connected in series with a capacitor 205 to provide single-pole filtering of the input speed signal 14. The voltage across the capacitor 205 is clamped by the diodes DI1 thru DI4 conventionally connected to the power supply of potential $V^+_c$ and ground. An integrated circuit IC1 is governed by the potential across the capacitor 205 developed from the speed signal 14. Balanced resistors 202 and 203 connect the capacitor 205 to the inverting (−) and non-inverting (+) inputs of the IC1. The IC1 functions as a comparator (typically LM311). A comparison reference voltage is generated by a resistor divider network comprising resistors 206 and 207and supplied to the (+) input of the IC1 through a resistor 210 and the (−) input of IC1 through resistor 208. A resistor 211 connected between the output 215 and (+) input of IC1 supplies positive feedback to protect against oscillations during transitions of the output 215 of IC1. The resistor network of resistors R212 and R213 limit the positive swing of the output of IC1 and capacitor 214 connected in parallel with resistor 213 provides additional filtering. In operation, the IC1 switches to a high state at times when the differential voltage of the input speed signal 14 is greater than the comparison reference voltage produced by resistor divider network 206 and 207 and to a low state at times when the differential voltage of the input speed signal 14 is less than the comparison reference voltage. Some hysteresis is introduced as a result of the positive feedback of resistor 211. The signal at the output 215 of the IC1 changes state with each "crossover" of the signal 14 with the reference voltage as shown in FIGS. 12A and 12B.

The signal 215 is a data input to an arrangement of 4 NOR gates 216 which function similar to a D-type flip-flop. A clock input to 216 is provided from the control line CB2 of the IU 27 using resistor 217 connected to the V+ supply as a "pull-up"resistor. An output signal 218 of the arrangement of NOR gates 216 is connected to both an input of exclusive "OR"gate 220 and the data input of a D-type flip-flop 221. The CA2 control line of IU 27 is inverted by inverter 222 to produce a signal 223 which is coupled to the clock input of flip-flop 221 and the reset input of an 8-stage counter 224. A non-inverted Q output signal 225 of the flip-flop 221 is supplied to the other input of the exclusive "OR" gate 220. An output signal 226 of gate 220 is used as the least significant bit (LSB) of the peripheral data bus of the B section of IU 27 (i.e. PBO). Signal 226 is also used as the clock input for the counter 224. The outputs 227, 228, . . ., 233 of the 7 least significant stages of the counter 224 are respectively coupled to the peripheral data bus lines PB1, PB2, . . ., PB7 of the IU 27. The output 234 of the most significant stage of the counter 224 is inverted by inverter 235 and connected to the CA1 control line of IU 27. The signal RTCINT 62A is connected to the CB1 control line of IU 27.

One possible example of operation of the speed monitoring apparatus 54 as described above is performed sequentially from the processing of an addressably ordered set of instructions and data words contained in one or more of the memory devices (PROM) 19, 20, 21 and 22 by the microprocessor 18. The microporcessor 18 communicates with IU 27 using the controlling inputs coupled thereto derived from the microporcessor bus 30 as shown in FIG. 2 and functions therewith in a similar manner as that described in connection with the typical interface unit of FIG. 5. Specifically, the control register of section A denoted by CRA having a hexadecimal assigned address $101 is initialized with the data word $FF wherein the dollar sign, $, indicates hexadecimal notation. In addition, the control register of section B of IU 27 denoted by CRB having an assigned address of $103 is initialized with the data word $27. The initialized contents of the control registers, CRA and CRB, establish the "handshaking"operation of the control lines CA1, CB1, CA2 and CB2 of IU 27. Both data direction registers, DDRA and DDRB, are initialized to $FF which program the peripheral data bases A and B to be inputs. A flowchart depicting the instruction processing by the microprocessor 18 of the addressably order set of instructions and data words which may be programmed in one or more of the memory devices 19, 20, 21 and 22 is found in FIG. 13 and the waveforms in response to said processing are found in FIGS. 12C through 12J.

Figure 12:
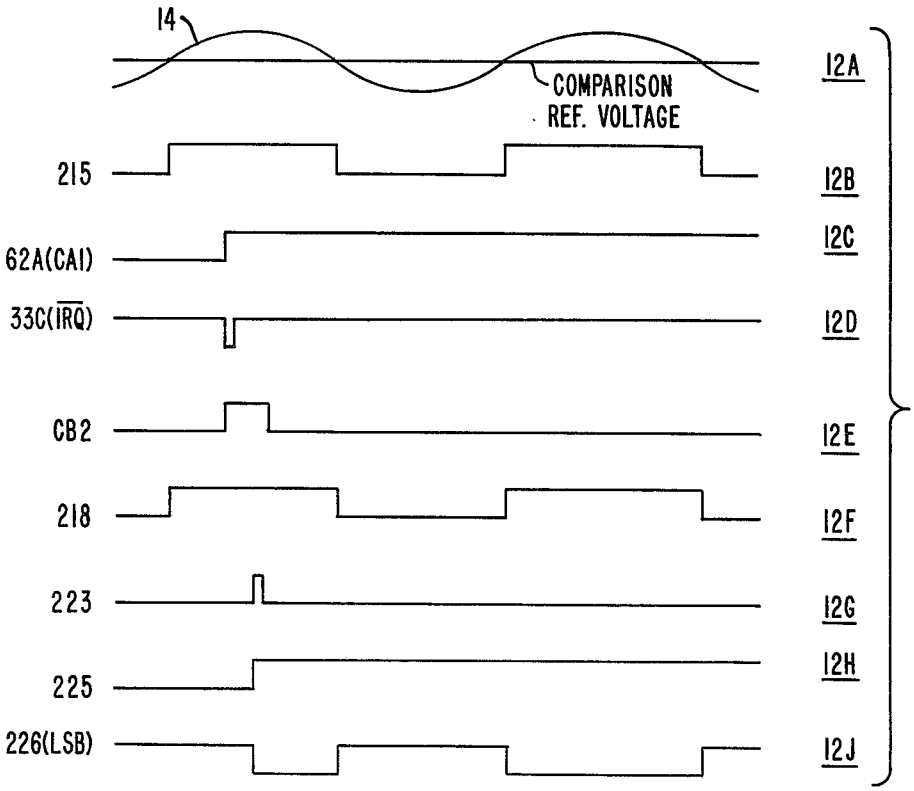
FIG. 12A through 12H and 12J illustrate the operation of the speed monitoring interface of FIG. 12 under one set of conditions.

More specifically, between low to high transitions of the clock signal 62A, the signal CB2 is maintained low permitting the signal 218 to follow signal 215 through the flip-flop arrangement of NOR gates 216 as shown in FIGS. 12B and 12F. Signal 218 affects gate 226 to respond by either inverting or not inverting signal 218 as determined by the state of the signal 225. As shown in FIGS. 12F, 12H and 12J, signal 226 is the inverted signal 218 when signal 225 is in the high state. The signal 226 is the LSB of the data word of the peripheral register B (PRB) of IU 27 and is used to increment the counter 224 with each high to low transition thereof. Therefore, each transition of the waveform 215 is accumulated using the signal 226 and a portion of the contents of counter 224.

Figure 13:
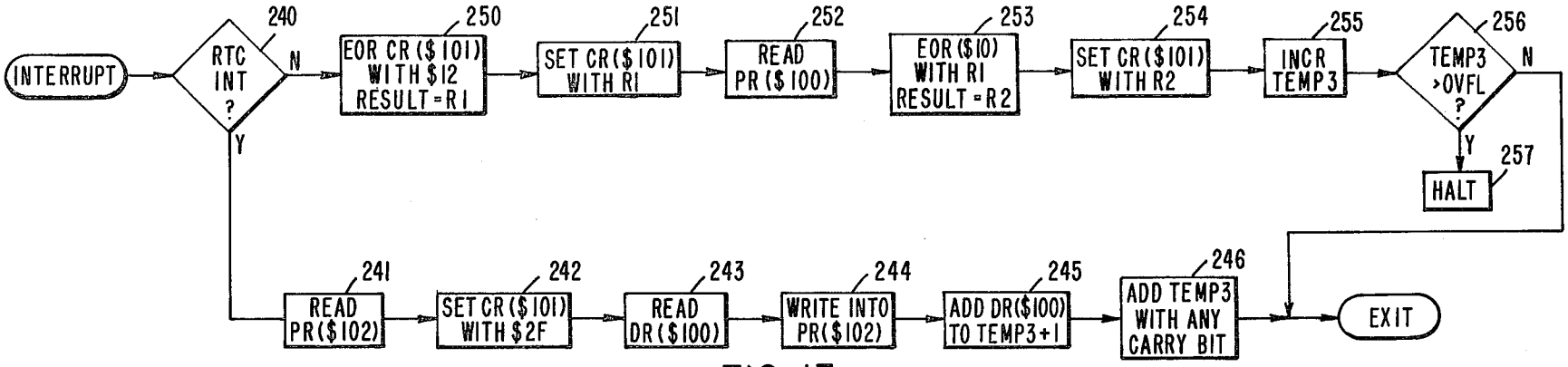
FIG. 13 is a flow chart of a program suitable for programming in one or more of the set of permanently programmable memory devices of FIG. 4 for use in the control of the speed monitoring interface of FIG. 12.

At the occurrence of a low to high transition of the signal 62A as shown in FIG. 12C, the CRB bit 7 is set (interrupt bit) generating a high to low transition or 1RQ control signal 33C and a low to high transition of signal CB2 of IU 27. With CB2 in the high state, the flip-flop 216 is disabled whereby signal 218 no longer follows signal 215 and does not disturb the digital state of the PRB of IU 27. When receiving an interrupt request 1RQ over signal line 33C, the microprocessor 18 initiates instruction processing starting at block 240 (refer to FIG. 13) which determines where the interrupt request originated. Since the 1RQ signal 33 was caused by the RTCINT signal 62A, processing will continue at block 241 which reads the contents of PRB of IU 27 ($102) into the microprocessor 18. The data word of PRB contains the accumulation of pulse transitions of signal 215 which occurred between low to high transitions of signal 62A (RTCINT). The data word of PRB is representative of the measured speed of the turbine 3. (Refer to FIG. 1). A read of the PRB ($102) resets the CRB bit 7 which produces a low to high transition of signal 33C (1RQ) as shown in FIG. 12D. Block 242 initializes CRA of IU 27 ($101) to $2F. Next in sequence, block 243 reads the contents of the PRA ($100) into the microprocessor 18 which initiates the reset pulse of control line CA2 causing signal 223 set high. The next occurrence of a $\theta_2$ clock pulse resets signal 223 low using signal CA2, as shown in FIG. 12G. This reset pulse over signal line 223, in addition to resetting the outputs of counter 224 to an initial counting state (typically all low), transfers the state of signal 218 to the signal line 225 using D-type flip-flop 221. As a result, then, since both inputs 218 and 225, of exclusive "OR" gate 220 are in the same state, the output signal 226, thereof will be effected to a low state. Thus, the reset pulse of FIG. 12G completely resets the contents of the PRB of IU 27 to an initial state (typically all low). A next instruction block 244 performs a write data word into PRB ($102) which affects a high to low transition of control line CB2 thereby enabling the flip-flop 216. A subsequent instruction block 245 adds the present read-in speed measurement data word of PRB to the contents of a temporary storage register having an assigned address TEMP3+1. Any carry bit resulting from the addition will be added to the contents of a temporary storage register having an assigned address TEMP3 using function block 246. The program of FIG. 13 is re-executed when another interrupt request (1RQ) over signal line 33C is received by the microprocessor 18 originating from either CA1 or CB1 of IU 27.

Figure 14:
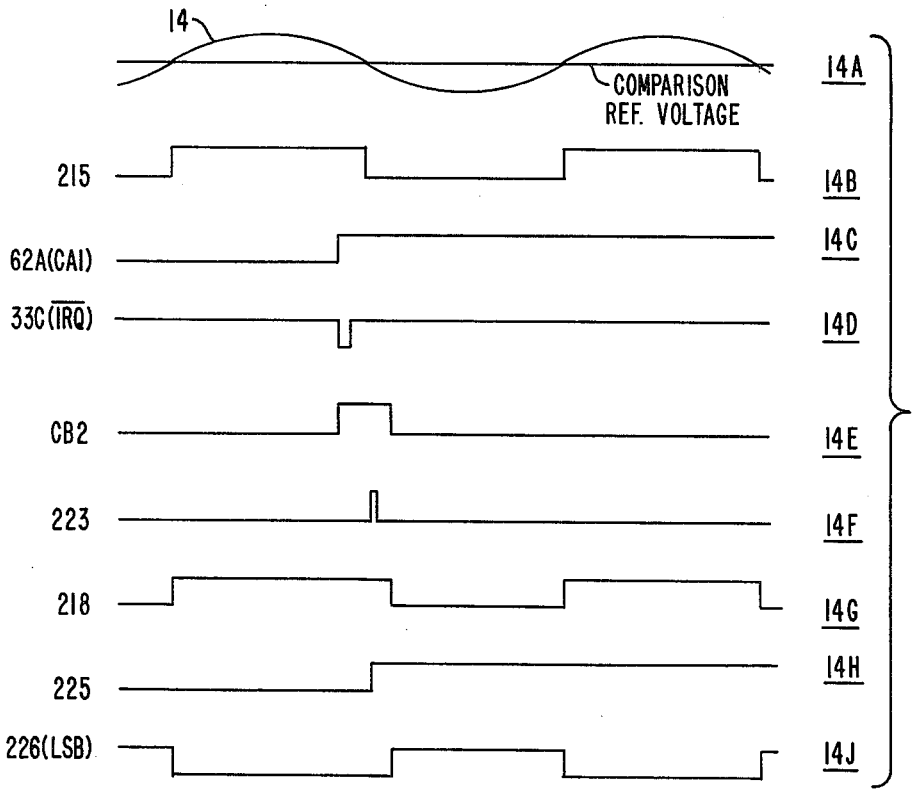
FIG. 14A through 14H and 14J illustrate the operation of the speed monitoring interface of FIG. 12 under another set of conditions.

Now suppose that a low to high transition of signal 62A occurs in time just prior to a transition of signal 215 as shown in FIGS. 14A, 14B and 14C. A similar operation (refer to FIGS. 14C to 14F) will recur as described above in response to a low to high transition of 62A, except that during the disabling of flip-flop 216 by signal CB2, a transition of 215 occurs. This transition is not accumulated into PRB of IU 27 because 216 is disabled. However, the reset pulse over signal line 223 (refer to FIG. 14F) captures the state of 218 which was the state of 215 at the time of the low to high transition of 62A (refer to FIGS. 14B, 14C, 14F, 14G and 14H) at its output 225. As CB2 is returned to a low state, the flip-flop 216 is enabled and signal 218 takes on the present state of signal 215 (see FIGS. 14B, 14E and 14G). Consequently, the exclusive "OR" gate produces a high state on signal 226, the LSB of PRB if IU 27 (refer to FIGS. 14G, 14H and 14J) because its inputs 218 and 225 are not equivalent. Thus, the transition of 215 which occurred during the time duration, during which the speed measurement data word of PRB ($102) is read by the microprocessor 18, is in effect saved by the speed monitoring apparatus 54 to be injected to signal line 226, the LSB of speed measurement data word (PRB), immediately following the read in instruction processing time duration of CB2.

Should the counter 224 exceed one half of its capacity in accumulating the transitions of signal 226 during the period in time between low to high transitions of 62A, the MSB, signal 234 will be set high. The CA1 control line of IU 27 will respond concurrently therewith by setting the CRA bit 7 which, in turn, generates an interrupt request (1RQ) over control line 33C. The microprocessor 18 vectors to a starting address of an instruction shown as function block 240 in FIG. 13 in response to the interrupt request. Since the interrupt was not originated from the (RTCINT) signal 62A, the instruction processing of the microprocessor 18 will begin at function block 250. In function block 250, the data word contained in CRA ($101) is exclusive "OR"ed with $12 and the result (R1) is written in CRA ($101) by function block 251. This is performed to inhibit the generation of a reset pulse over control line CA2 in response to the read PRA $100 which results from next function block 252. The read $100 is necessary to reset the bit 7 of CRA of IU 27 and return the interrupt request line 33C to a high state. Next, function block 253 performs an exclusive "OR" between result, R1, and $10 and the result, R2, of the exclusive "OR" operation is written into CRA ($101) of IU 27 using function block 254. Function blocks 253 and 254, by reprogramming the contents of CRA of IU 27 permits the control line CA1 to alternately respond to low to high and high to low transitions of the MSB of counter 224 which both at times indicate a counter overflow event. In function block 255, a temporary storage register in memory 23 having an assigned address TEMP3 is incremented. The decision block 256 determines if the capacity of register TEMP3 has exceeded a predetermined value denoted as OVFL. If it has, the processing of the microprocessor 18 is halted by block 257. Otherwise, program processing is continued at another instruction address. The programming flow path initiating at function 250 will only be executed when an interrupt request is received by the microprocessor 18 over signal line 33C originating from bit 7 of CRA of IU 27. Appendix A herein contains an actual program written in assembly language suitable for programming in one or more of the memory devices 19 through 22 for performing the process control operations defined by the flow chart of FIG. 13.

Circuitry for generating an analog speed signal 57 is included with the apparatus 54 as shown in FIG. 11A. Signal 215 is additionally coupled to the data input of a D-type flip-flop 260. An output signal 261 from the flip-flop 260 is coupled to the data input of another D-type flip-flop 262. Signal 62B (PACL) controls the clock input of both flip-flops, 260 and 262. The output signal 261 is connected to one input of an exclusive "OR" gate 263 and the other input thereof is supplied by an output signal 264 from flip-flop 262. The signal 265 generated by the exclusive "OR" gate 263 controls the switching of a single-pole-double-throw (SPDT) analog switch contained in an integrated circuit IC2. The IC2 may be of the type manufactured by Siliconix, Inc.; Model No. DG190. Connected to position 266 of the SPDT switch of IC2 is a reference voltage $V_{REF}$ and the other switch position 267 thereof is connected to ground potential. A resistor 270 provides a current path to ground potential from the pole 268 of the switch of IC2. The potential developed across resistor 270 at point 272 is an input to the circuit 271, which is a conventional double-pole filter circuit comprising resistors 273, 274 and 275 and capacitors 276 and 277 arranged about an operational amplifier IC3 (typically a 741). The filter circuit 271 is used to filter the signal 272 derived from the switching operation of IC2. The filtered output 278 of circuit 271 is an input to the non-inverting amplifier circuit including an operational amplifier IC4 wherein resistors 280, 281 and potentiometer P1 establish the closed-loop gain thereof. Resistor 279 is used to balance the input impedance between the (+) and (−) inputs of op amp IC4. Potentiometer P2 is conventionally coupled to IC4 and used for zero adjustment. The analog speed signal 57 is generated at the output of op amp IC4.

Figure 15:
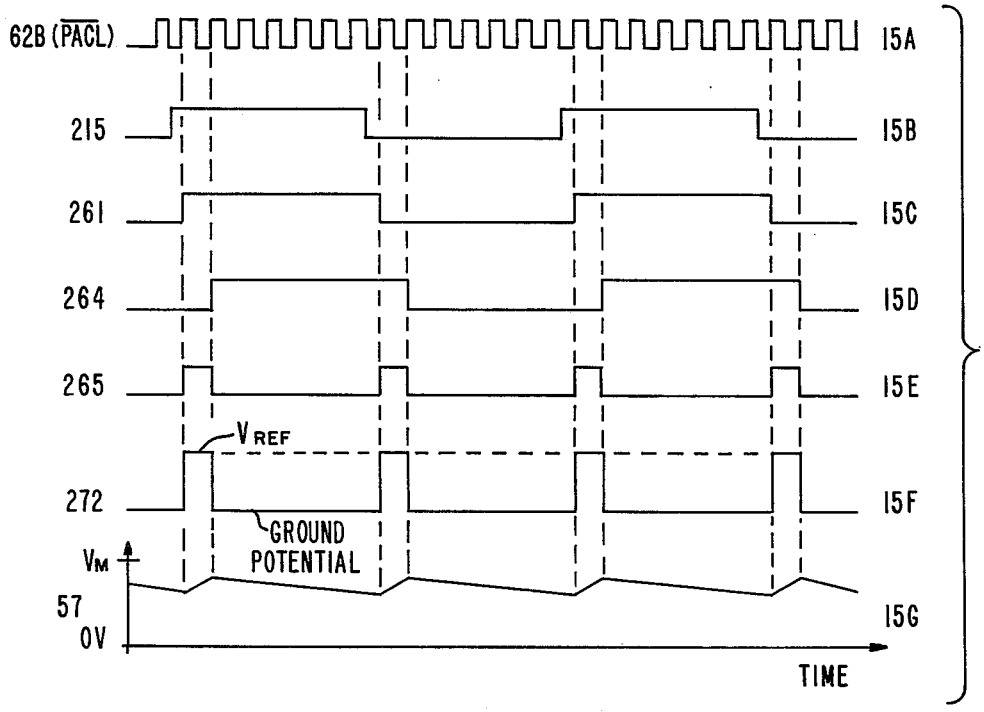
FIG. 15A through 15G are waveforms which illustrate operation of an analog speed signal generation portion of the speed monitoring interface of FIG. 12.

In operation, the PACL, signal 62B, controls the transfer of the state of the speed signal 215 to the output of flip-flop 260 with each rising edge thereof (refer to FIGS. 15A, 15B and 15C). Additionally, with each rising edge, signal 62B transfers the state of signal 261 to the output of the flip-flop 262 as shown in FIG. 15D. The output signal 265, shown in FIG. 15E, of the exclusive "OR" gate drives the SPDT switch of IC2 to pulse rate modulate the $V_{REF}$ signal at point 272. The pulse rate modulated signal at 272 is filtered by circuitry 271 and gain and zero adjusted by the circuitry of IC4 to generate the analog speed signal 57 as depicted by FIG. 15G.

Four digital input signals 43 are signal conditioned using circuits similar to circuit 190 previously described above and are coupled to the least significant 4 bits of the A section peripheral data bus of interface unit 27. A set of 4 single-pole-single-throw switches 58 are coupled to the most significant 4 bits of the A section peripheral data bus of IU 27. The state of the 4 switches 58 may be used as an address vectoring to one or more constants contained in a table of constants programmed in the memory modules 19 through 22 as one possible application. All of the peripheral data bus signals of IU 27 are programmed as inputs for the purposes of this embodiment.

Figure 16A:
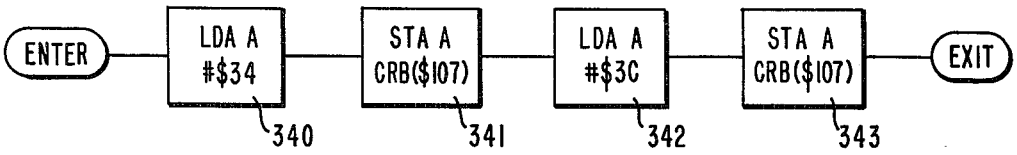
FIGS. 16A and 16B are flow charts of programs suitable for programming on one or more of the set of permanently programmable memory devices of FIG. 4 for use in the control of the program execution failure detection circuit embodied in the schematic diagram of FIG. 16.
Figure 16B:
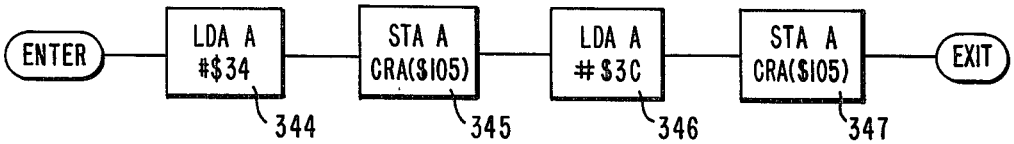
Figure 16:
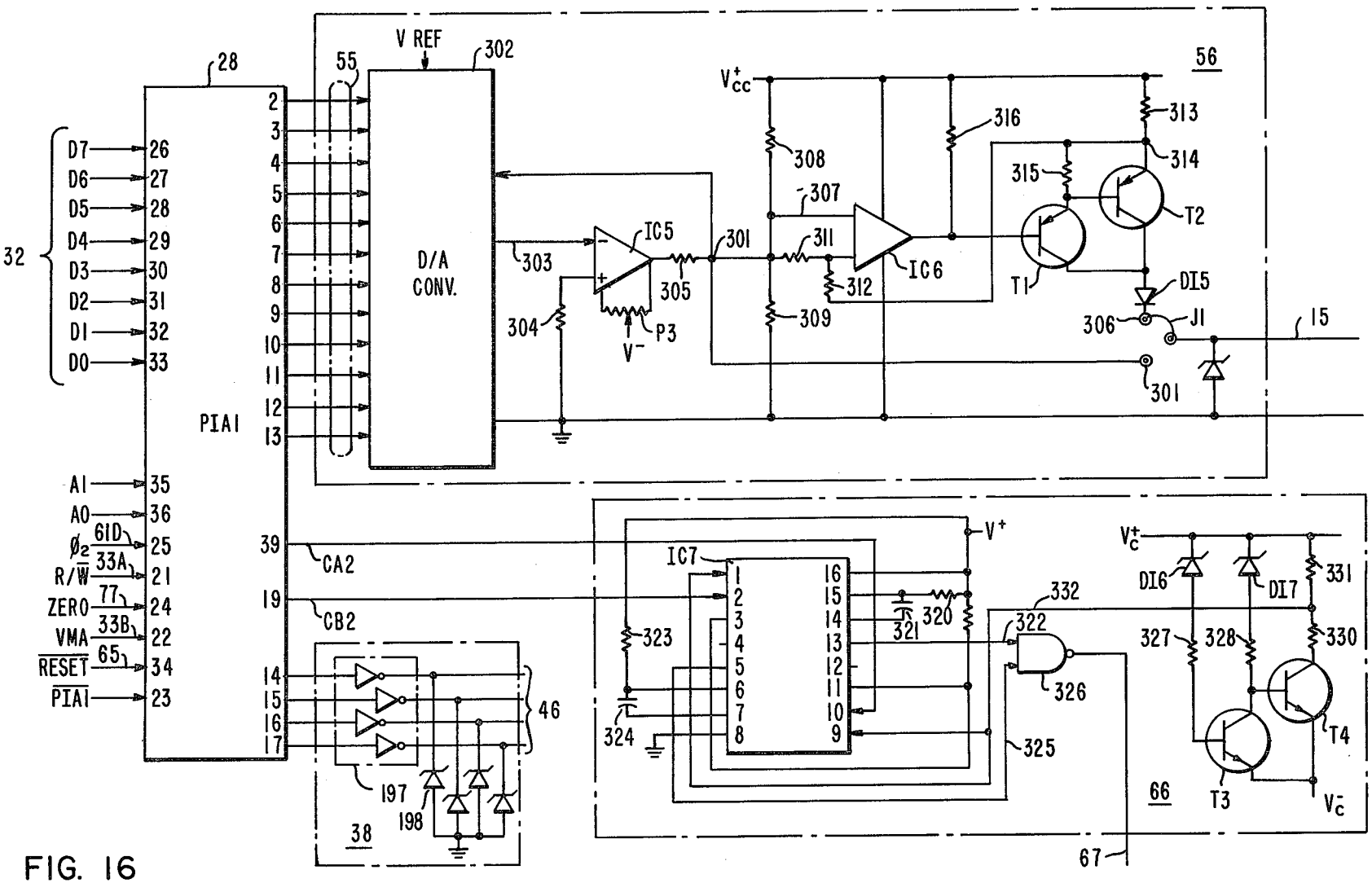
FIG. 16 principally provides a more detailed schematic diagram of a speed control signal generation circuit and a program execution failure detection circuit suitable for use in the embodiment of FIG. 1.

Referring to FIG. 16, an analog speed signal 15 is generated by a speed control signal generator 56 connected to the interface unit 28. The interface unit 28 is connected to the microprocessor bus 30 in a similar manner as that described above and functions in accordance with that described for the typical interface unit of FIG. 5. The peripheral data bus word (pins 2 through 9 of IU 28) of the A section and the least significant 4 bits of the B section of IU 28 form a 12-bit data word 55 which is converted to an analog signal 301 by the digital-to-analog (D/A) converter 302. A voltage reference $V_{REF}$ signal is supplied to D/A converter 302. An operational amplifier IC5 is used to convert a current signal 303 of D/A 302 to a voltage signal 301. A resistor 304 is connected from the (+) input of IC5 to ground to provide a reference common mode potential at the (+) and (−) inputs of IC5. Potentiometer P3 is coupled to IC5 for the purposes of zero adjusting the output signal 301 of IC5. Resistor 305 connected in series with the output of IC5 offers overcurrent protection to IC5. The voltage signal 301 may be converted to a current signal at point 306 by the voltage-to-current circuitry arranged about an operational amplifier IC6. A voltage signal 307 is produced by the voltage divider network comprising resistors 308 and 309 connected between voltage supply $V^+_{cc}$ and ground. The voltage signal 307 provides a common mode voltage reference for the (+) and (−) inputs of IC6. A resistor 311 is connected between the (−) input of IC6 and the signal 301. A current flows through resistor 311 proportional to the signal 301. A resistor 312 is coupled in series between the collector of transistor T2 point 314 and the (−) input of IC6. Assuming that an insignificant amount of current flows into the (−) input of IC6, then the current through resistor 312 is approximately the same as the current through resistor 311 which is linearly proportional to the signal 301. The voltage produced at point 314 as a result of the current through resistor 312 defines the current through a resistor 313 which is connected between point 314 and $V^+_{cc}$.

For example, if the common mode voltage at the (−) input of IC6 is set at +16V. and the range of signal 301 is from 0 to +10V., then when signal 301 is at 0 V., the current through resistor 311 (typically 20 K) may be 0.8 milliamp (ma.). If the voltage supply $V^+_{cc}$ is made 24 V. and the resistor 312 is selected approximately 10 K, then the voltage at point 314 is 34 V. with 0.8 ma. through resistor 312. Since there is no voltage drop across resistor 313, then no current may be generated therethrough. When signal 301 is at +10V, approximately 0.3 ma. conducts through resistors 311 and 312, thereby producing a voltage at point 314 of approximately 19V. The approximate 5 V. drop across resistor 313 (typically 250 ohm) generates a current on the order of 200 ma. therethrough. The op amp IC6 provides the drive current for the full range current of 200 ma. using a Darlington configuration of transistors T1 and T2 wherein the base of T2 is connected to the collector of T1 and the base of T1 is connected to the output of IC6. The collectors of T1 and T2 are connected together. A resistor 315 may be connected between the collector and the base of T2 to supply the leakage current associated with T2. Resistor 316 tied between $V^{+cc}$ and the output of IC6 provides a quiescent potential reference connection for the op amp IC6. Op amp IC6 generates sufficient base current through the Darlington configuration of T1 and T2 to bring about the voltage at point 314 to satisfy conditions at its (+) and (−) inputs. Current through resistor 313, transistor T2 and diode D5 may be used as the output signal 15 should a jumper J1 connect output line 15 with signal point 306. This current as described above is governed by the voltage signal 301. The signal 301 may be used as the output signal 15 directly should the jumper J1 be connected between signal 15 and 301, for example.

A circuit 66 for detecting a malfunction in program execution of microprocessor 18 is coupled to the interface unit 28 using control signals CA2 and CB2. The signal CA2 is an input to one of a pair of retriggerable monostable multivibrators contained in an integrated circuit IC7 (typically a 74123). Resistor 320 and capacitor 321 coupled between the power supply $V^+$ and IC7 define the width of the pulse generated over signal line 322 by one of the monostables IC7 with each occurence of a low to high transition of signal CA2. Should the time period between the low to high transistions of CA2 be less than the pulse width of 322, then the signal over line 322 may remain high until such time as the signal CA2 ceases to generate low to high transitions, for example. Similarly, signal CB2 is an input to the other of a pair of retriggerable monostable multivibrators of IC7 and resistor 323 and capacitor 324 coupled thereto define the width of the pulse generated over signal line 325 thereby in response to each occurrence of a low to high transition of signal CB2. And, accordingly, should the time period between low to high transitions of CB2 be less than the pulse width of 325, then the signal over line 325 may remain high until such time as the signal CB2 ceases to generate low to high transitions, for example. The signals over lines 322 and 325 are inputs to a NAND gate 326 to produce a signal at point 67. Should either or both signals over lines 322 and 325 be low as controlled by signals CA2 and CB2, respectively, the signal at point 67 will appear high being indicative of the occurrence of a malfunction as one possibility.

In addition, circuitry including transistors T3 and T4 monitors the power supply potentials $V^+_c$ and $V^-_c$ which are used primarily to supply power to portions of the analog circuitry. A zenor diode DI6 in series with a resistor 327 are connected between $V^+_c$ and the base of transistor T3. The emmiters of T3 and T4 are both connected to $V^-_c$. A Zener diode DI7 in series with a resistor 328 are connected between $V^+_c$ and both the collector of T3 and base of T4 which are coupled together. Normally, the differential voltage between potentials $V^+_c$ and $V^-_c$ is sufficient to cause conduction of DI7, but not D6. Therefore, transistor T3 is blocked and T4 is "switched on" by the base current supplied through DI7 in series with resistor 328. Two resistors 330 and 331 are connected in series between $V^+_c$ and the collector of transistor T4. When T4 is "switched on", the potential of the collector is approximately equal to $V^-_c$. A signal line 332 is connected from the point of connection of the resistors 331 and 330 to each of the monostable multivibrators of IC7. The potential of the signal over line 332 at times when T4 is "switched on" is such to enable operation of the retriggerable monostables of IC7. Should either power supply potential $V^+_c$ or $V^-_c$ increase or decrease in potential magnitude beyond a predetermined limit defined by the circuit elements DI6, DI7, 327, 328, T3 and T4, then the signal over line 332 may increase in magnitude and disable the operation of IC7 forcing the outputs 322 and 325 of IC7 to a low state causing the output signal 67 of NAND gate 326 to go high which may be indicative of a malfunction.

Control lines CA2 and CB2 are, in one operating mode, controlled to trigger the monostables of IC7 in accordance with a set of instructions programmed in one or more of the memory devices 19 through 22 for periodic processing by the microprocessor 18. One possible example of a set of instructions for controlling the registers, CRA and CRB, of IU 28 are shown in FIGS. 16A and 16B. Referring to 16A, instruction block 340 loads the hexadecimal number $34 into accumulator A of microprocessor 18 and instruction block 341 stores the contents of accumulator A ($34) into CRB ($107) of IU 28. Instruction blocks 342 and 343 store the hexadecimal number $3C in CRB ($107) of IU 28. Each time instructions 340, 341, 342 and 343 are processed by microprocessor 18, the control line CB2 of IU 28 goes from a high state to low state and back to a high state. A similar set of instruction blocks 344 through 347 as shown in FIG. 16B are sequentially processed by the microprocessor 18 to control CA2 to go from a high state to a low state and back to a high state.

Also, coupled to the most significant 4 bits of the B section peripheral data bus of IU 28 is a digital output buffer circuit 38. The circuitry 38 comprises buffer inverters 197 and Zener diodes 198 as previously described in connection with circuits 35 and 36 above to drive peripheral devices over lines 46. All the peripheral data bus lines of IU 28 are programmed as outputs.

Figure 17:
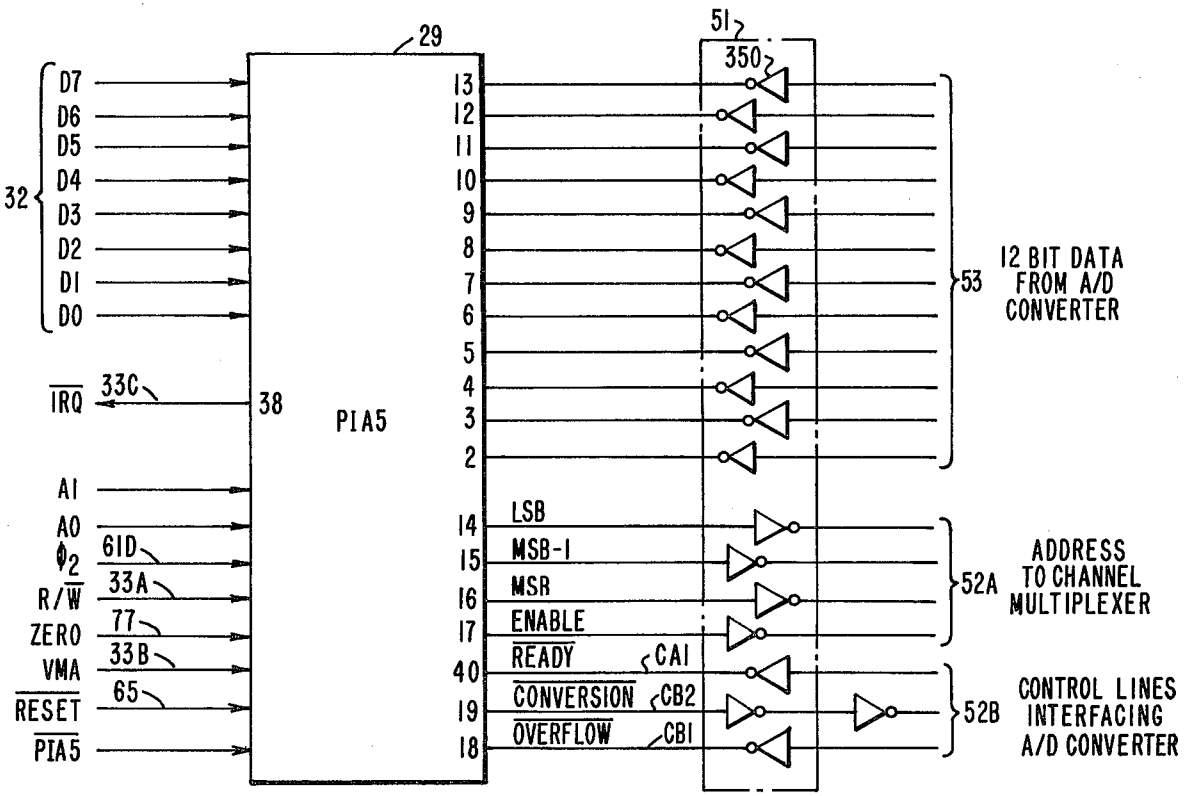
FIG. 17 is a more detailed schematic of an A/D converter interface buffer circuit suitable for use in the embodiment of FIG. 1.

Referring to FIG. 17, the interface unit 29 is attached to the microprocessor bus 30 and functions similarly to that described in connection with FIG. 5 above. An analog-to-digital (A/D) interface buffering circuit 51 comprising a plurality of conventional inverters 350 which may be similar to the type 7404 is provided to offer "hand shaking" communication with an A/D subsystem. The A section peripheral bus and the least significant 4 bits of the B section peripheral bus of IU 29 are programmed to input a 12-bit data word using signal lines 53 as one example. The four most significant bits of the B section peripheral data bus are programmaed to output signals over lines 52A which may be used to address and enable analog data output channels of an analog signal multiplexer which may be coupled thereto. Control lines CA1 and CB1 may be programmed as inputs and control line CB2 as an output to provide control of an A/D converter over lines 52B. One possible example of operation may be to first output the address over lines 52A, pulse the convert line CB2 to start an A/D conversion and monitor the input line CA1 for an end of A/D conversion signal. Upon detection of an end of conversion (READY) over line CA1, read in the 12-bit data word over lines 53 and test input CB1 for a possible overflow or out-of-range analog input. It is understood that this operation is only one of many which can be programmed into the memory modules 19 through 22 for processing by the microprocessor 18.

Figure 18:
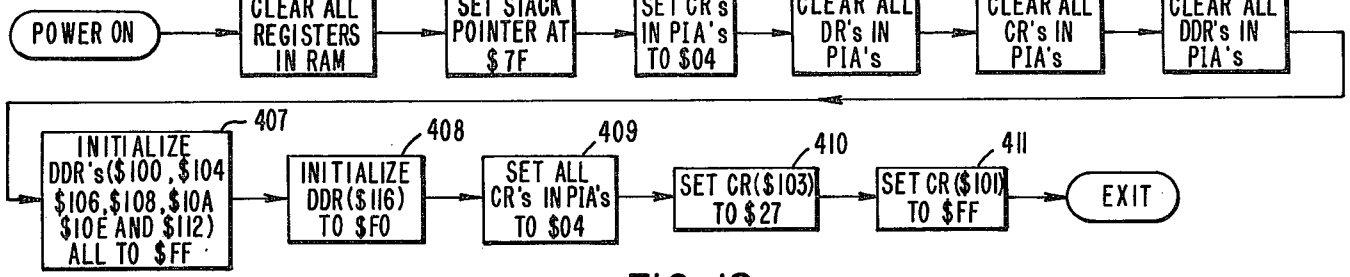
FIG. 18 is a flow chart of a program suitable for programming in one or more of the set of permanently programmable memory devices of FIG. 4 for use in the initialization of predetermined circuits in accordance with the embodiment of FIG. 1.

An initialization program is used to initialize the microprocessor based speed controller 1 of FIG. 1 upon power turn-on. An initialization pulse over signal line 65 generated by the power-on initialization circuit 64 generally forces the contents of memory address $FFFF and $FFFE into the program counter of the microprocessor 18 to start program execution. A typical initialization program flow chart is shown in FIG. 18 and an actual program written in assembly language suitable for programming in one or more of the memory devices 19 through 22 for performing the process control operations as defined by the flow chart of FIG. 18 is found herein in Appendex B. The instruction block 401 clears the contents of all the registers in the temporary storage memory 23 and block 402 sets the stack pointer of microprocessor 18 at a memory location in 23 generally $7F. Instruction block 403 sets the contents of all the control registers of the interface units 24 through 29 to $04 and then, block 404 clears the contents of all the peripheral data bus registers of the interface units. All of the control registers (CR) are cleared by instruction block 405 and then, the contents of all of the data direction registers (DDR) are cleared using block 406. The instruction block 407 initializes the contents of the DDR's having addresses $100, $104, $106, $108, $10A, $10E, and $112 to $FF and block 408 sets the DDR having the address $116 to $FO. All of the CR's are again set to $04 in block 409. Instruction blocks 410 and 411 set CR's having the addresses $103 and $101 to $27 and $FF, respectively. The instruction processing then proceeds to that which controls the operation of the speed controller 1 of FIG. 1.

Although the embodiment is presented controlling a steam turbine, it is understood that the programmable speed controller described above may be used to control other prime mover devices such as a gas turbine, for example. In addition, the use of Motorola's microprocessor family of integrated circuits in the above embodiment provided a means of illustrating and describing the principles of the invention. Other microprocessor system devices may be used in their place to perform the same functions without departing from the invention described herein. It is desired, then, that the invention not be limited by the embodiment described herein but rather it be interpreted in accordance with its scope and broad principles.

```
01860 F600                ORG     $F600
01870 F600 B6 0101 INT    LDA A   PIOCRA        TEST SOURCE OF INTERRUPT
01880 F603 2A 16          BPL     RTCIN
01880 F605 88 12          EOR A   #$12          TOGGLE INT. CONTROL BIT
01900 F607 B7 0101        STA A   PIOCRA
01910 F60A F6 0100        LDA B   PIOPRA
01920 F60D 88 10          EOR A   #$10          ENABLE AUTO RESET FUNCTION
01930 F60F B7 0101        STA A   PIOCRA
01940 F612 7C 0028        INC     TEMP3
01950 F615 2B 01          BMI     WILD
01960 F617 3B             RTI                   RETURN FROM INTERRUPT
01970 F618 3E       WILD  WAI                   FAILURE DETECT EXIT. HALT A
01980 F619 32       WILD1 PUL A                 FIX STACK
01990 F61A 3E             WAI                   HALT

02010                 * REAL TIME CLOCK INTERRUPT

02030 F61B F6 0102 RTCIN LDA B PIOPRB           LOAD COUNT, CLEAR INTERRUPT
02040 F61E 86 2F          LDA A #$2F            RESET OVERFLOW
02050 F620 B7 0101        STA A PIOCRA
02060 F623 B6 0100        LDA A PIOPRA          SCAN SWITCHES, CLR. COUNTER
02070 F626 B7 0102        STA A PIOPRB          ENABLE COUNTER
02080 F629 36             PSH A                 SAVE SWITCH SCAN
02090 F62A 4F             CLR A                 ACCUMULATE SPEED READING IN
02100 F62B DB 29          ADD B TEMP3+1
02110 F62D D7 29          STA B TEMP3+1
02120 F62F 99 28          ADC A TEMP3
02130 F631 97 28          STA A TEMP3
02140 F633 7A 002B        DEC   DISUP           DECREMENT TIMER
02150 F636 2A 04          BPL   SK2
02160 F638 86 1F          LDA A #31
02170 F63A 97 2B          STA A DISUP
02180 F63C 96 2B    SK2   LDA A DISUP           TEST ODD/EVEN
02190 F63E 46             ROR A
02200 F63F 24 03          BCC   SK3             EVEN SCHEDULE
02210 F641 7E F701        JMP   SPCON           ODD SCHEDULE
0220 F644 96 02     SK3   LDA A SPM+2           SAVE SPM
02230 F646 97 26          STA A TEMP1
02240 F648 D6 01          LDA B SPM+1
02250 F64A 96 00          LDA A SPM
02260 F64C 36             PSH A

02280                 * .5 SEC FILTER ON SPM

02300 F64D 86 04          LDA A #4              CALC. SPM/16
02310 F64F 77 0000 SPMLP  ASR   SPM
02320 F652 76 0001        ROR   SPM+1
02330 F655 76 0002        ROR   SPM+2
02340 F658 4A             DEC A
```

```
02350 F659 26 F4          BNE   SPMLP
02360 F65B 96 26          LDA A TEPM1
02370 F65D 90 02          SUB A SMP+2          CALC. SPM- SPM/16

01130 FE46                ORG     $FE46
01140           * CLEAR PAGE ZERO

01160 FE46 4F             CLR A
01170 FE47 8E 007F        LDS     #$7F
01180 FE4A C6 80          LDA B   #128
01190 FE4C 36  ZCLR       PSH A
01200 FE4D 5A             DEC B
01210 FE4E 26 FC          BNE     ZCLR
01220 FE50 8E 007F        LDS     #7F

01240           * SET CONTROL REGISTERS TO 4
01250 FE00                ORG     $FE00

01270 FE00 8E 007F        LDS     #$7F
01280 FE03 CE 0100        LDX     #$100
01290 FE06 86 04          LDA A   #4
01300 FE08 8D 4D          BSR     PIAST

01320           * CLEAR PIA DATA REGISTERS

01340 FE0A 4F             CLR A
01350 FE0B 09             DEX
01360 FE0C 8D 49          BSR     PIAST

01380           * CLEAR PIA CONTROL REGISTERS

01400 FE0E 8D 47          BSR     PIAST

01420           * CLEAR DATA DIRECTION REGISTERS

01440 FE10 09             DEX
01450 FE11 8D 44          BSR     PIAST

01470           * INITIALIZE PIA'S FROM POWER ON RESET

01490 FE13 CE 0100 INILZ LDX      #$100
01500 FE16 6A 04          DEC     4,X      INITIALIZE DD-1
01510 FE18 6A 06          DEC     6,X
01520 FE1A 6A 08          DEC     8,X      INITIALIZE DD-2
01530 FE1C 6A 0A          DEC     $A,X
01540 FE1E 6A 0E          DEC     $E,X     INITIALIZE DD-3
01550 FE20 6A 12          DEC     $12,X    INITIALIZE DD-4
01560 FE22 86 F0          LDA A   #$F0     INITIALIZE DD-5
01570 FE24 A7 16          STA A   $16,X
01580 FE26 86 04          LDA A   #4
01590 FE28 8D 2D          BSR     PIAST    SET CONTROL REGISTER TO 4
01600 FE2A 86 27          LDA A   #RTCEN   RTC INT. AND ENCK CONTROL
01610 FE2C A7 03          STA A   3,X
01620 FE2E 86 FF          LDA A   #$FF
01630 FE30 A7 01          STA A   1,X      OVERFLOW INT. AND CLR. CONT
01640 FE32 86 50          LDA A     #$50
01650 FE34 B7 0106        STA A     $106
01660 FE37 FF FFFF        STX       $FFFF
01670 FE3A FF FFFF        STX       $FFFF
01680 FE3D FF FFFF        STX       $FFFF
01690 FE40 FF FFFF        STX       $FFFF
01700 FE43 FF FFFF        STX       $FFFF

01720 FE53                ORG       $FE53
01730 FE53  0E            CLI
01740 FE54 3E     WAIT    WAI
01750 FE55 20 FD          BRA       WAIT

1770 FE57 06 00   PIAST LDA  B      #$C
1780 FE59 A7 01   INLP1 STA A       1,X   SET ALL PIA REGISTERS TO CO
1790 FE5B 08            INX
1800 FE5C 08            INX
1810 FE5D 5A            DEC B
1820 FE5E 26 F9         BNE         INLP1
1830 FE60 CE 0100       LDX         #$100
1840 FE63 39            RTS               RETURN
```

We claim:

1. A programmable turbine speed controller apparatus comprising:

a plurality of permanently programmable memory devices for storage of addressably ordered sets of selected instructions and data words;

a microprocessor bus;

means for coupling said plurality of permanently programmable memory devices to said microprocessor bus in accordance with an addressable pattern;

a system clock for generating a first periodic timing signal;

a microprocessor coupled to said microprocessor bus and governed by said first periodic timing signal to process the instructions and data words of said plurality of permanently programmable memory devices;

a real time clock for generating a second periodic timing signal;

a speed monitoring means coupled to said microprocessor bus and governed by the microprocessor in accordance with a first set of instructions processed thereby at a predetermined time in each period of the second timing signal to generate at least one speed measurement data word, representative of the actual speed of a turbine, during each period of the second timing signal;

a temporary memory means, coupled to said microprocessor bus, for storage of temporary data words resulting from the instruction processing operations of the microprocessor; and means coupled to said microprocessor bus and governed by a data word from said microprocessor to generate an output signal proportional to said data word for controlling the speed of a turbine.

2. A programmable turbine speed controller apparatus in accordance with claim 1 wherein the permanently programmable memory devices are read-only-memories (ROM's).

3. A programmable turbine speed controller apparatus in accordance with claim 1 wherein the speed monitoring means is further governed by the second timing signal to generate a first interrupt signal at a specified time in each period of the second timing signal for interrupting the processing of instructions by the microprocessor.

4. A programmable turbine speed controller apparatus in accordance with claim 3 wherein the microprocessor is responsive to each of the first interrupt signals to sequentially process the first set of instructions to control the generation of at least one speed measurement data word by the speed monitoring means during each period of the second timing signal; and wherein the instruction processing of said first set of instructions by the microprocessor defines a time interval during each period of the second timing signal.

5. A programmable turbine speed controller apparatus in accordance with claim 4 wherein the time interval is synchronous with the second periodic timing signal.

6. A programmable turbine speed controller apparatus in accordance with claim 4 wherein the speed monitoring means includes:

means for generating a train of signals representative of the actual speed of a turbine;

means for counting signals from said generated train of signals representative of actual turbine speed to form at least one speed measurement data word during each period of the second timing signal;

means for inhibiting the counting means from counting during each of the instruction processing time intervals;

means governed by the microprocessor to permit reading of the speed measurement data word present in said counting means concurrent with each of the time intervals by the microprocessor during each of the corresponding time intervals;

means governed by the microprocessor to reset said counting means to an initial counting state during each of the time intervals defined by the processing of the first set of instructions; and means for storing any one signal of said generated train of signals which may occur concurrent with the time interval; and wherein said storing means being further operative to inject a count representative of said stored signal into said counting means immediately after the time interval during which the signal was stored, whereby the storing means reduces the possibility of missing a speed signal count during the instruction processing time intervals.

7. A programmable turbine speed controller apparatus in accordance with claim 6 wherein each of the time intervals is less than any time between signals of the generated train of signals representing the actual turbine speed.

8. A programmable turbine speed controller apparatus in accordance with claim 6 wherein the speed monitoring means further includes means governed by the counting means to generate a second interrupt signal which is an indication that the count in the counting means has exceeded a predetermined capacity thereof.

9. A programmable turbine speed controller apparatus in accordance with claim 8 wherein the microprocessor is responsive to the second interrupt signal to sequentially process a second set of instructions to accumulate the speed measurement data words generated by the speed monitoring means during the corresponding period of the second timing signal in which the second interrupt signal is generated.

10. A programmable turbine speed controller apparatus in accordance with claim 9 wherein the generated second control signal is asynchronous to the periodic second timing signal 11. A programmable turbine speed controller apparatus in accordance with claim 3 wherein the first interrupt signal is synchronous with the periodic second timing signals.

12. A programmable turbine speed controller apparatus in accordance with claim 1 wherein:

the microprocessor processes the instructions and data words of the memory devices in a time sequenced addressable pattern characterized by the addressable order of the instruction words of the memory devices, said instruction processing operations being synchronous to the first periodic timing signal and performed over at least one period thereof, said microprocessor being operative to concurrently generate at the completion of each of said processing operations an address word and a set of control signals which are in one state as a result of the processing of one instruction word to control the microprocessor to read in instructions and data words and are in another state as a result of the processing of another instruction word to control the microprocessor to write out processed data words;

the speed monitoring means transfers each speed measurement word generated thereby to the microprocessor as governed by a first address word and a read control signal state concurrently generated by said microprocessor;

the speed control signal generating means accepts the speed control signal data word from the microprocessor as governed by a second address word and a write control signal state concurrently generated by the microprocessor;

the permanently programmable memory devices when coupled to the microprocessor bus using the coupling means transfers the instructions and data words programmed therein to the microprocessor as governed by a corresponding memory device address word and a read control signal state generated concurrently by the microprocessor; and the temporary memory means transfers data words to and from the microprocessor as governed by a corresponding temporary memory address word and read and write control signal states, respectively, generated by the microprocessor.

13. A programmable turbine speed controller apparatus in accordance with claim 1 further comprising:

a power supply bus for conducting power to the turbine speed controller utilizing a plurality of power supply potentials;

first means, coupled to the microprocessor bus, for generating a first pulse which is initiated by a third address word, a first data word and a write control signal state concurrently generated by the microprocessor and terminated by a third address word, a second data word and a write control signal state concurrently generated by the microprocessor;

second means governed by one of the plurality of potentials of the power supply bus to generate a power supply failure signal at times when any one of the governing power supply potentials deviates from a corresponding predetermined value; and third means governed by said first and second means to generate a signal indicative of malfunction of turbine speed controller operation.

14. A programmable turbine speed controller apparatus in accordance with claim 13 wherein the first means generates a second pulse which is initiated by a fourth address word, a first data word and a write control signal state concurrently generated by the microprocessor and terminated by a fourth address word, a second data word and a write control signal state concurrently generated by the microprocessor; and wherein the third means includes two monostable multivibrator circuits each being triggered by a corresponding one of the two pulses generated by the first means to each generate an output signal, said two monostable multivibrator circuits being both disabled from generating an output signal by said power supply failure signal generated by said second means; and wherein further generation of both output signals by the two monostable multivibrator circuits of the third means inhibits the generation of the malfunction indication signal thereby.

15. A programmable turbine speed controller apparatus in accordance with claim 13 further comprising:

means for controlling the state of a plurality of digital output signals of the turbine speed controller in the form of at least one digital output word, said means being coupled to said microprocessor bus to accept each digital output word from the microprocessor as governed by a corresponding digital output address word and a write control signal state generated by said microprocessor; and means for monitoring the states of a plurality of input signals of the turbine speed controller in the form of at least one digital input word, said means being coupled to said microprocessor so as to transfer each digital input word to said microprocessor as governed by a corresponding digital input address word and a read control signal state generated by said microprocessor.

16. A programmable turbine speed controller apparatus in accordance with claim 15 wherein each means which is coupled to the microprocessor bus except the microprocessor, plurality of permanently programmable memory devices and temporary memory means has included therein at least two of each control registers, data direction registers and peripheral bus data registers.

17. A programmable turbine speed controller apparatus in accordance with claim 16 and further including a power-on initialization means, coupled to the microprocessor, for generating an initialization pulse at the time of power turn-on; and wherein the microprocessor is responsive to said initialization pulse to sequentially process a third set of instructions to initialize each of the control registers, the data direction registers and the peripheral bus data registers in accordance with the operation to be performed thereby.

18. A programmable turbine speed controller apparatus in accordance with claim 1 wherein the first and second periodic timing signals are synchronously generated from a same clock means; and wherein said same clock means is programmable utilizing a read-only-memory.

19. A turbine speed controller apparatus comprising:

means for generating a periodic train of signals representative of the actual speed of a turbine;

a real time clock for generating a periodic timing signal;

counting means governed by the periodic train of signals representative of the actual turbine speed to generate at least one speed measurement data word during each period of said real time clock timing signal;

interrupt means governed by said real time clock timing signal to generate a first control signal for each period of the real time clock timing signal;

control means interrupted by said first control signal to read and store therein within a predetermined time interval the speed measurement data word present in the counting means concurrent with each first control signal;

inhibit means governed by said control means to inhibit said counting means during each predetermined time interval:

reset means governed by said control means to reset said counting means to an initial state within each predetermined time interval;

means governed by the control means to generate a signal for controlling the speed of a turbine;

means governed by the control means to inject a count representative of a signal of said periodic train of signals into said counting means immediately after said predetermined time interval only when a signal of said periodic train of signals occurs during said predetermined time interval, whereby no signals of the train of signals representing the actual turbine speed are lost during the read operation of the control means.

20. A turbine speed controller apparatus in accordance with claim 19 wherein the first control signal generated by the interrupt means is synchronous to the real time clock periodic timing signal.

21. A turbine speed controller apparatus in accordance with claim 19 wherein each predetermined time interval is less than the period of the train of signals representing the actual turbine speed.

22. A turbine speed controller apparatus in accordance with claim 19 and including means for generating a second control signal at a time when the count in the counting means has exceeded a predetermined capacity thereof; and wherein the control means is interrupted by said second control signal to accumulate the speed measurement data words generated by the counting means during the corresponding period of the real time clock timing signal in which the second control signal is generated.

23. A turbine speed controller apparatus in accordance with claim 22 wherein the second control signal is asynchronous to the real time clock periodic timing signal.

24. A method for monitoring the speed of a turbine, comprising the steps of:

(a) generating a periodic train of signals representative of the actual speed of a turbine;
(b) counting the periodic train of signals in a counter;
(c) inhibiting the counting of said counter;
(d) thereafter reading the contents of said counter, representative of a speed measurement data word, by a turbine speed controller;
(e) thereafter resetting the counter to an initial counting state;
(f) thereafter enabling the counting of said counter;
(g) injecting a count into said counter at the time said counter is enabled only when a signal of said periodic train of signals occurs during the preceding time said counter was inhibited from counting; and
(h) repeating steps (c) through (g) after a predetermined time interval.

25. A method for monitoring the speed of a turbine in accordance with claim 24 wherein each repeating predetermined time interval is equal to another, whereby steps (c) through (g) of claim 24 are processed periodically.

26. A method for monitoring the speed of a turbine in accordance with claim 24 wherein the time during which the counter is inhibited is less than any period of the train of signals representing the actual turbine speed.

27. A method for monitoring the speed of a turbine in accordance with claim 24, further comprising the steps;

interrupting the turbine speed controller at times when the count of the counter has exceeded a predetermined capacity thereof;

thereafter accumulating a count representative of the predetermined capacity of the counter in a register in the turbine speed controller; and adding the predetermined capacity counts which occur during one predetermined time interval to the contents of the counter which are read by the turbine speed controller at the end of said one predetermined time interval to generate an accumulated speed data word.

* * * * *